US007415237B2

(12) United States Patent
Okoshi

(10) Patent No.: US 7,415,237 B2
(45) Date of Patent: Aug. 19, 2008

(54) CLEANING UNIT, PROCESS CARTRIDGE USING CLEANING UNIT, AND IMAGE FORMING APPARATUS USING CLEANING UNIT

(75) Inventor: Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 330 days.

(21) Appl. No.: 11/242,912

(22) Filed: Oct. 5, 2005

(65) Prior Publication Data

US 2006/0216083 A1 Sep. 28, 2006

(30) Foreign Application Priority Data

Mar. 25, 2005 (JP) ..... P2005-089627

(51) Int. Cl.
*G03G 21/00* (2006.01)

(52) U.S. Cl. ..... 399/350; 399/111; 399/123

(58) Field of Classification Search ..... 399/107, 399/111, 123, 343, 350, 351, 358, 360
See application file for complete search history.

(56) References Cited

U.S. PATENT DOCUMENTS 6,975,830 B2 * 12/2005 Murakami et al. ..... 399/358
7,024,134 B2 * 4/2006 Yokomori et al. ..... 399/111
7,058,337 B2 * 6/2006 Hashimoto et al. ..... 399/111
7,072,594 B2 * 7/2006 Hoshi et al. ..... 399/27
7,184,686 B2 * 2/2007 Kanno et al. ..... 399/111

FOREIGN PATENT DOCUMENTS

JP 10-301460 A 11/1998
JP 2002-123143 A 4/2002
JP 2003-162191 A 6/2003

* cited by examiner

*Primary Examiner*—Hoan H Tran
(74) *Attorney, Agent, or Firm*—Sughrue Mion, PLLC

(57) ABSTRACT

A cleaning unit includes: a cleaning housing which is open toward an image carrier and has a waste toner accommodating part; a cleaning member which scrapes and collects the waste toner on the image carrier; a waste toner storage part storing the waste toner temporarily; and a waste toner conveying member which conveys the waste toner scraped and collected by the cleaning member from the waste toner storage part toward the waste toner accommodating part, wherein: the waste toner conveying member moves in the advancing/retracting direction along the waste toner storage part; and when the waste toner conveying member moves in the retracting direction, the waste toner conveying member moves in contact with the waste toner, and when the waste toner conveying member moves in the advancing direction, the waste toner conveying member moves without contacting the waste toner.

23 Claims, 19 Drawing Sheets

CLEANING UNIT, PROCESS CARTRIDGE USING CLEANING UNIT, AND IMAGE FORMING APPARATUS USING CLEANING UNIT

BACKGROUND OF THE INVENTION

1. Field of the Invention

The present invention relates to a cleaning unit used in an image forming apparatus such as an electrophotographic copying machine and a printer, and in particular, to a cleaning unit which conveys waste toner collected by a cleaning member, a process cartridge using the cleaning unit, and an image forming apparatus using the cleaning unit.

2. Background Art

Conventionally, in an image forming apparatus using, for example, an electrophotographic method, an electrostatic latent image formed on an image carrier such as a photoconductive drum is developed (visualized) with toner by a developing unit, and then the toner images formed by the developing unit are transferred onto a transfer medium such as a paper and an intermediate transfer body by a transfer unit, and toner remaining on the surface of the image carrier is collected by a cleaning unit.

Further, as a cleaning unit, a so-called blade cleaning method, in which a plate shaped cleaning blade is mounted, to a periphery of an opening of a cleaning housing which is open toward the image carrier, and the cleaning blade scrapes off residual toner on the image carrier by bringing the cleaning blade into contact with the image carrier to thereby collect the toner in the cleaning housing, has been widely adopted.

However, except for a case in which waste toner scraped and collected by the cleaning blade immediately falls downward, this kind of blade cleaning methods has drawbacks. That is, in a structure in which the cleaning blade is disposed to face a rotational direction of the image carrier and the rotational direction of the image carrier is downward from above, waste toner scraped and collected by the cleaning blade inevitably is place on an upper portion of the cleaning blade.

A technique for preventing a case, in which waste toner scraped and collected by the cleaning blade is placed on the upper portion of the cleaning blade to damage a waste toner collecting operation due to a cleaning member, and for conveying the waste toner scraped and collected by the cleaning blade to a waste toner accommodating part located at an inner side of the cleaning housing by using a waste toner conveying member, has already been proposed.

As such a technique, for example, a technique in which a rotary driving part is provided above the upper portion (serving as the waste toner storage part) of the cleaning blade and the waste toner conveying member is rotated by the driving part such that the waste toner accumulated in the waste toner storage part is conveyed toward the waste toner accommodating part has been proposed (see JP-A-10-301460).

Further, as another technique in the related art, for example, as shown in FIG. 19A, a technique in which a waste toner conveying member 515 extending between a waste toner accommodating part 512 inside a cleaning housing 511 and the upper portion (waste toner storage part) of the cleaning blade 513 is provided, a rotary driving part 520 (for example, using a crank arm) is provided at a waste toner accommodating part 512 side of the waste toner conveying member 515, the waste toner conveying member 515 is slidably supported by a supporting member 521, and a free end of the waste toner conveying member 515 is rotated to convey the waste toner accumulated in the waste toner storage part toward the waste toner accommodating part 512 has been proposed (see JP-A-2002-123143 and JP-A-2003-162191).

Furthermore, as the waste toner conveying member 515, for example, as shown in FIG. 19B, one in which a frame member 516 has a multi-stage frame structure and openings 517 are provided in the frame member 516 so as to perform waste toner conveying operations at a plurality of places. In FIG. 19A, reference numerals 500, 501, and 502 denote an image carrier, a charged roll, and a cleaning unit, respectively.

However, in each of the cleaning units disclosed in JP-A-10-301460, JP-A-2002-123143 and JP-A-2003-162191, a portion for serving to convey waste toner is rotated by the waste toner conveying member, so that the portion for serving to convey waste toner comes in only line-contact with the waste toner storage part (upper portion of the cleaning blade). Even though a plurality of portions for serving to convey waste toner is provided, the conveying efficiency of the waste toner on the waste toner storage part is apt to be insufficient.

In addition, a large upper space of the waste toner storage part needs to be secured in order to allow the rotary movement of the portion for serving to convey waste toner, which increases the vertical length of the cleaning housing. As a result, a technical problem in which the cleaning unit becomes large occurs.

SUMMARY OF THE INVENTION

The invention is designed to solve the above-mentioned problems, and it is an object of the invention to provide a cleaning unit which can be made thin and can keep an excellent conveying efficiency of the waste toner in a waste toner conveying method, a process cartridge using the cleaning unit, and an image forming apparatus using the cleaning unit.

According to a first aspect of the invention, there is provided a cleaning unit including: a cleaning housing which is open toward an image carrier and has a waste toner accommodating part capable of accommodating waste toner; a cleaning member which is provided around an edge of an opening of the cleaning housing so as to form a part of a waste toner storage part or the entire waste toner storage part at a location close to the waste toner accommodating part of the cleaning housing and which scrapes and collects the waste toner on the image carrier, the waste toner storage part storing the waste toner temporarily; and a waste toner conveying member which conveys the waste toner scraped and collected by the cleaning member from the waste toner storage part toward the waste toner accommodating part of the cleaning housing, wherein: the waste toner conveying member moves in the advancing/retracting direction along the waste toner storage part; and when the waste toner conveying member moves in the retracting direction toward the waste toner accommodating part, the waste toner conveying member moves in contact with the waste toner along at least the part of the waste toner storage part, and when the waste toner conveying member moves in the advancing direction, the waste toner conveying member moves along at least the part of the waste toner storage part without contacting the waste toner.

According to a second aspect of the invention, there is provided a process cartridge detachably mounted to a main body of an image forming apparatus, including: an image carrier; and the cleaning unit according to the first aspect of the invention, the cleaning unit being disposed to face the image carrier and being capable of cleaning up waste toner on the image carrier.

According to a third aspect of the invention, there is provided an image forming apparatus including the process cartridge according to the second aspect of the invention.

According to a fourth aspect of the invention, there is provided an image forming apparatus including: an image carrier; and the cleaning unit according to the first aspect of the invention, the cleaning unit being disposed to face the image carrier and being capable of cleaning up waste toner on the image carrier.

According to the cleaning unit of the invention, since the waste toner conveying member moves in the advancing/retracting direction along the waste toner storage part, that is, the waste toner conveying member moves in contact with the waste toner along at least the part of the waste toner storage part when the waste toner conveying member moves in the retracting direction toward the waste toner accommodating part and the waste toner conveying member moves along at least the part of the waste toner storage without contacting the waste toner when the waste toner conveying member moves in the advancing direction, the waste toner accumulated in the waste toner storage part can be prevented from turning back toward a direction becoming separated from the waste toner accommodating part, so that it is possible to effectively convey the waste toner toward the waste toner accommodating part.

Therefore, the conveying efficiency of the waste toner on the waste toner storage part can be satisfactorily maintained, the abrasion of a sliding portion between the waste toner conveying member and the waste toner storage part can be reduced, and it is possible to effectively prevent a blocking phenomenon due to the turned-back waste toner or contamination inside the cleaning unit.

Further, according to the cleaning unit of the invention, since the waste toner conveying member can move in the advancing/retracting direction along the waste toner storage part without preparing a rotary driving force input part at the upper space of the waste toner storage part, a space corresponding to the rotary driving force input part is not required to be prepared at the upper space of the waste toner storage part, so that it is possible to make the upper space of the waste toner storage part as narrow as possible.

Therefore, according to the invention, the cleaning unit can be made thin, and cleaning capability (capability of conveying waste toner) can be satisfactorily maintained.

Furthermore, according to the process cartridge using the cleaning unit or the image forming apparatus using the cleaning unit, it is possible to simply realize a process cartridge or an image forming apparatus which is small and whose cleaning capability (capability of conveying waste toner) is excellent.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Figure 1A:
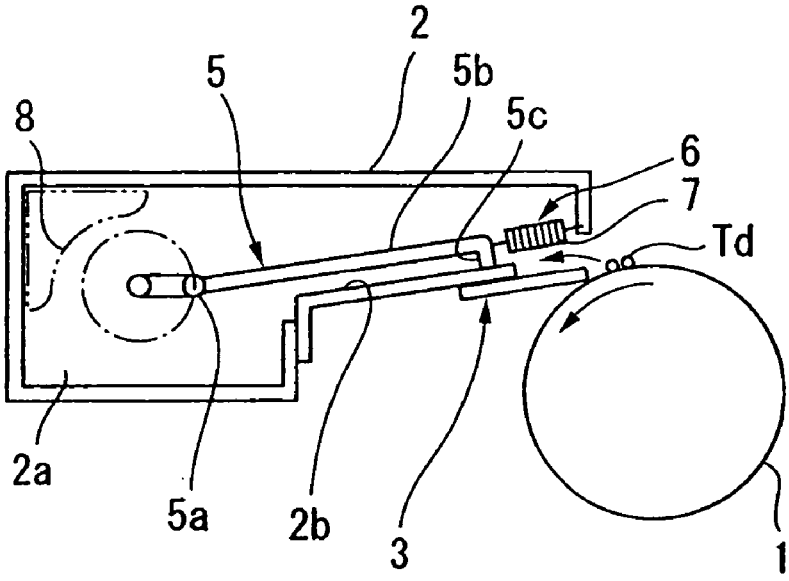
FIG. 1A is an explanatory view schematically showing a cleaning unit according to the present invention.
Figure 1B:
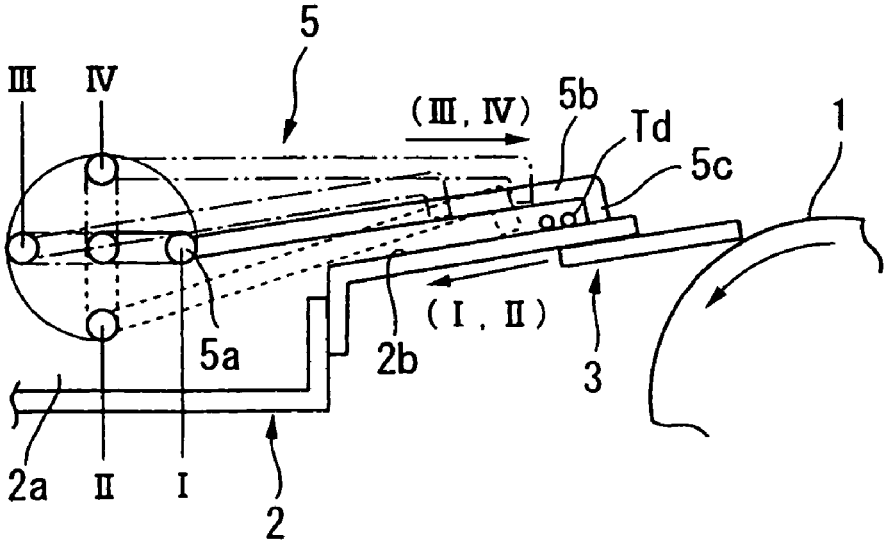
FIG. 1B is an explanatory view showing the movement of a waste toner conveying member.

According to an aspect of the invention, as shown in FIGS. 1A and 1B, a cleaning unit includes: a cleaning housing 2 which is open toward an image carrier 1 and has a waste toner accommodating part 2*a* capable of accommodating waste toner at an inner side thereof separated from the image carrier 1; a cleaning member 3 which is provided around an edge of an opening of the cleaning housing 2 so as to form a part of a waste toner storage part 2*b* or the entire waste toner storage part 2*b* at a location close to the waste toner accommodating part 2*a* of the cleaning housing 2 and which scrapes and collects the waste toner Td on the image carrier 1, the waste toner storage part 2*b* storing the waste toner temporarily; and a waste toner conveying member 5 which conveys the waste toner Td scraped and collected by the cleaning member 3 from the waste toner storage part 2*b* toward the waste toner accommodating part 2*a* of the cleaning housing 2. The waste toner conveying member 5 moves in the advancing/retracting direction along the waste toner storage part 2*b*. When the waste toner conveying member 5 moves in the retracting direction toward the waste toner accommodating part 2*a*, the waste toner conveying member 5 moves (for example, refer to I and II in FIG. 1B) in contact with the waste toner along at least the part of the waste toner storage part 2*b*, and when the waste toner conveying member 5 moves in the advancing direction, the waste toner conveying member 5 moves (for example, refer to III and IV in FIG. 1B) along at least the part of the waste toner storage part 2*b* without contacting the waste toner.

In the configuration of the invention, the waste toner Td is placed at an upper side of the cleaning member 3 assuming that the cleaning member 3 is located at the edge of a lower portion of the opening of the cleaning housing 2.

Further, as the cleaning member 3, a blade provided on a supporting holder, or a scraper itself may be used.

Furthermore, the waste toner storage part 2*b* may be composed of only the cleaning member 3, or may be composed of the cleaning housing 2 and the cleaning member 3.

Here, it is preferable that the waste toner storage part 2*b* have an inclined surface portion inclined downward toward the waste toner accommodating part 2*a*. In this case, the inclined surface portion is effective to increase the conveying efficiency of the waste toner Td.

In addition, the movement of the waste toner conveying member 5 includes the advancing and retracting movement along the waste toner storage part 2*b*.

Here, when the waste toner conveying member 5 moves in the retracting direction, the waste toner conveying member 5 needs to move in contact with the waste toner along at least the part of the waste toner storage part 2*b*. At this time, 'to move in contact with the waste toner' is to be understood that the waste toner conveying member 5 may come in contact with the waste toner storage part 2*b*, or may come in contact with the waste toner on the waste toner storage part 2*b* without contacting the waste toner storage part 2*b* itself. Thereby, the waste toner can be efficiently conveyed toward the waste toner accommodating part 2*a*. Here, even though it is not needed that the entire area of the waste toner conveying member 5 is in contact with the waste toner on the waste toner storage part 2*b* when the waste toner conveying member 5 moves in the retracting direction, since the waste toner conveying member 5 needs to move in contact with at least a part of the waste toner storage part 2*b*, the waste toner conveying member 5 and the waste toner on the waste toner storage part 2*b* need to be in a surface contact state, not in a line contact state.

On the other hand, the waste toner conveying member 5 needs to move along at least the part of the waste toner storage part 2*b* without contacting the waste toner when the waste toner conveying member 5 moves in the advancing direction, which is effective for preventing a situation in which the waste toner accumulated in the waste toner storage part 2*b* turns back toward a direction becoming separated from the waste toner accommodating part 2*a* (a situation in which the conveying capability of waste toner deteriorates). In this case, from a point of the conveying efficiency of the waste toner, in the waste toner conveying member 5, the non-contact area with respect to the waste toner on the waste toner storage part 2*b* is preferably large.

Here, it is preferable that the waste toner conveying member 5 have a plate shaped or frame shaped member 5*b*, and the member 5*b* is provided with a protrusion 5*c* and an opening or a notch at a location where the protrusion 5*c* is not provided, the protrusion 5*c* being capable of coming in contact with the waste toner on the waste toner storage part 2*b*. The opening or the notch serves to turn the waste toner Td placed on the waste toner conveying member 5 back to the waste toner storage part 2*b* and prevents the waste toner Td from scattering due to a wind pressure caused by air resistance.

Further, preferably, the waste toner conveying member 5 has a protrusion 5*c* at a location separated from a driving force input part 5*a* from which a driving force can be input, the protrusion 5*c* being capable of coming in contact with the waste toner on the waste toner storage part 2*b*. According to the configuration, the protrusion 5*c* serves to scrape and collect the waste toner Td accumulated in the waste toner storage part 2*b*.

Here, the protrusion 5*c* may be formed by bending a part of the member 5*b* of the waste toner conveying member 5, or by attaching a separate member to the member 5*b*. In addition, one or a plurality of protrusions 5*c* may be formed, and a cross section of the protrusion 5*c* may be appropriately selected from a circular arc shape, an acute angle shape, or a flat shape having a narrow width.

Furthermore, preferably, the waste toner conveying member 5 has a member 5*b* extending between the waste toner storage part 2*b* and the waste toner accommodating part 2*a* and a portion at a waste toner accommodating part 2*a* side of the member 5*b* is the driving force input part. As such, if the driving force input part 5*a* is located at the waste toner accommodating part 2*a* side, the driving force input part 5*a* does not directly affect the upper space of the waste toner storage part 2*b*.

In particular, in the waste toner conveying member 5, it is preferable that a driving power having a rotary locus be input to the driving force input part 5*a*. The configuration is preferable in that the driving force can be most easily used since the driving power having a rotary locus can be simply formed by a crank axis or the like.

At this time, preferably, the waste toner conveying member 5 is configured such that an opposite side of the driving force input part 5*a* of the member 5*b* moves along non-circular locus which has flat parts on the upper and lower parts. In this case, the non-circular locus includes an elliptical locus, a polygonal locus, or the like.

Moreover, preferably, the driving force input part 5*a* is input with a driving force rotating such that the waste toner accommodated in the waste toner accommodating part 2*a* is pressed against a direction becoming separated from the cleaning member 3. According to the configuration, the waste toner accommodated in the waste toner accommodating part 2*a* is pressed against a depth direction becoming separated from the cleaning member 3, so that it is possible to enhance the accumulating efficiency of the waste toner accumulated in the waste toner accommodating part 2*a*. Also, it is possible to make the cleaning unit small and flat by effectively using the space of the waste toner accommodating part 2*a*.

Further, in a case in which a rotary driving method is adopted, preferably, when the driving force input part 5*a* is located at the top dead center, the waste toner conveying member 5 keeps an approximately horizontal and uppermost position and moves along a locus not protruding upward from the uppermost position. As such, by configuring such that the position of the waste toner conveying member 5 at the top dead center of the driving force input part 5*a* is almost horizontal and uppermost, it is possible to make the cleaning unit small.

Furthermore, in another case in which the rotary driving method is adopted, preferably, the waste toner conveying member 5 has a protrusion 5*c* being capable of coming in contact with the waste toner on the waste toner storage part 2*b*, and when the driving force input part 5*a* reaches a lowermost position, the waste toner on the waste toner storage part 2*b* comes in contact with the protrusion 5*c* and the member 5*b* extending between the waste toner accommodating part 2*a* and the waste toner storage part 2*b* does not come in contact with the waste toner on the waste toner storage part 2*b*.

According to the configuration, by considering the layout of the waste toner conveying member 5 at the bottom dead center of the driving force input part 5*a*, it is possible to prevent the interference between the waste toner conveying member 5 and the waste toner storage part 2*b*.

In addition, preferably, the waste toner conveying member 5 moves in an approximately horizontal state when the waste toner conveying member 5 moves in the advancing direction. As such, if the waste toner conveying member 5 keeps the almost horizontal state when the waste toner conveying member 5 moves in the advancing direction, it is possible to make the upper space of the waste toner storage part 2*b* narrow, which gives an optimal condition to make the cleaning unit thin.

Moreover, preferably, the waste toner conveying member 5 has a member 5*b* extending between the waste toner storage part 2*b* and the waste toner accommodating part 2*a*, and the maximum vertically moving distance at a waste toner storage part 2*b* side of the member 5*b* is set to be smaller than that at a waste toner accommodating part 2*a* side of the member 5*b*. As such, by making the vertically moving distance of the member 5*b* on the waste toner storage part 2*b* small, it is possible to make the cleaning unit thin.

Further, preferably, the waste toner conveying member 5 has a member 5*b* extending between the waste toner storage part 2*b* and the waste toner accommodating part 2*a*, and the member 5*b* has a guide aiding part capable of guiding the waste toner with respect to a width direction perpendicular to the advancing/retracting direction of the member 5*b*.

The guide aiding part includes any type of guide aiding part capable of guiding the waste toner toward an intended direction (width direction perpendicular to the advancing/retracting direction of the member 5*b*).

Here, for example, preferably, the member 5*b* corresponding to the waste toner storage part 2*b* is provided with a guide aiding part disposed at an end portion of the member 5*b* in the width direction thereof, and the waste toner is pushed toward the center of the width direction. As such, it is possible to effectively prevent an excessive pressure from being applied to a sealed part located at an end portion of the cleaning member 3.

Furthermore, since both ends of the driving force input part 5*a* of the waste toner conveying member 5 are generally disposed to extend outward from the width direction of the cleaning member 3, a dimension of the space in the width direction of the waste toner accommodating part 2*a* is larger than that in the width direction of the cleaning member 3. In this case, a proper number of guide aiding parts are provided to the member 5*b* corresponding to the waste toner accommodating part 2*a*, and the waste toner is pushed outward from the both ends of the width. Thereby, it is possible to effectively accumulate the waste toner even in a space located at the both sides of the width direction of the waste toner accommodating part 2*a*.

In addition, in the invention, it is preferable that a position regulating mechanism 6 for regulating the position of the waste toner conveying member 5 be provided. The configuration is very effective to control the contact between the waste toner conveying member 5 and the waste toner on the waste toner storage part 2*b*.

Here, preferably, the position regulating mechanism 6 is composed of an urging member 7, one end of the urging member 7 being engaged with a portion separated from a driving force input part 5*a* of the waste toner conveying member 5 and the other end thereof being engaged with a part of the cleaning housing 2, and the waste toner conveying member is urged toward the direction becoming separated from the driving force input point.

In the configuration, the urging member 7 serves to regulate the position variation range of the waste toner conveying member 5 with respect to the location variation of the driving force input part 5*a* of the waste toner conveying member 5.

Further, when the cleaning housing 2 is provided with a locking part of the urging member 7, in a structure in which a locking hole for external connection is provided, the locking hole needs to be sealed with a sealing material because there is a possibility that the waste toner leaks therefrom. In this case, it is preferable that label adhered to a CRU (Customer Replaceable Unit) be combined to the sealing material.

Furthermore, preferably, the urging member 7 is disposed to be inclined with respect to the advancing/retracting direction of the waste toner conveying member 5. According to the above configuration, it is possible to save the space and to set small the amount of expansion and contraction (or an expansion and contraction rate) of the urging member 7 with respect to the moving distance of the waste toner conveying member 5.

In addition, preferably, the urging direction of the urging member 7 is inclined toward the vertical direction of the waste toner storage part 2*b* rather than a surface of the waste toner storage part 2*b*. In this case, it becomes easy to adjust the movement locus at the opposite side of the driving force input part 5*a* of the waste toner conveying member 5, so that the conveying efficiency of the waste toner on the waste toner storage part 2*b* can be reliably maintained.

Moreover, preferably, assuming that the waste toner conveying member 5 is disposed so as to be capable of coming in contact with the waste toner storage part 2*b*, the position regulating mechanism 6 has a position restraint member 8 (shown by two-dot chain line in FIG. 1) which is engaged with a part of the waste toner conveying member 5 and makes the waste toner conveying member 5 not contacting the waste toner storage part 2*b* when the waste toner conveying member moves in the advancing direction.

In the configuration, it is possible to use a position restraint member 8 which functions when the waste toner conveying member 5 moves in the advancing direction and makes the waste toner storage part 2*b* not contacting the waste toner conveying member 5. Also, even though the driving force input part 5*a* is provided at the end portion of the waste toner conveying member 5 in FIG. 1A, in a case in which the configuration described above is realized, for example, the driving force input part 5*a* may be provided at another location other than the end portion of waste toner conveying member 5 or at an extending portion thereof, and the end portion at a waste toner accommodating part 2*a* side of the waste toner conveying member 5 may be engaged with the position restraint member 8.

When the position regulating mechanism 6 (position restraint member 8) is used, preferably, the waste toner conveying member 5 has a protrusion 5*c* at a location separated from a driving force input part 5*a* from which a driving force can be input, the protrusion 5*c* being capable of coming in contact with the waste toner on the waste toner storage part 2*b*, and the center of the waste toner conveying member 5 is located at a position deflected toward the protrusion 5*c* with respect to the driving force input part 5*a*. In the configuration, assuming that waste toner conveying member 5 is not engaged with the position restraint member 8, it is possible to keep the protrusion 5*c* of the waste toner conveying member 5 being in contact with the waste toner on the waste toner storage part 2*b* by means of center balance of the waste toner conveying member 5.

Further, preferably, the position regulating mechanism 6 has a position regulating guide which is engaged with a part of the waste toner conveying member 5 and is capable of regulating the position of the waste toner conveying member 5. In the configuration, for example, a guide groove following a predetermined movement locus is provided at a side wall of the cleaning housing 2 and the waste toner conveying member 5 is provided with a guide pin, and then the guide pin is slidably engaged with the guide groove.

Furthermore, the invention is not limited to the cleaning unit described above, but can be applied to a process cartridge or an image forming apparatus to be described below.

According to another aspect of the invention, as shown in FIG. 1A, a process cartridge detachably mounted to a main body of an image forming apparatus includes: an image carrier 1; and the cleaning unit which is disposed to face the image carrier 1 and is capable of cleaning up waste toner Td on the image carrier 1.

In addition, according to still another aspect of the invention, an image forming apparatus includes: an image carrier 1; and the cleaning unit which is disposed to face the image carrier and is capable of cleaning up waste toner on the image carrier. The cleaning unit may or may not be a process cartridge type.

Next, it will be described how the above-described parts serve.

Here, as shown in FIG. 1B, it is assumed that the waste toner Td adhered to the image carrier 1 is cleaned by the cleaning member 3 to be accumulated in the waste toner storage part 2*b*.

Further, in the waste toner conveying member 5, the member 5*b* extending between the waste toner storage part 2*a* and the waste toner accommodating part 2*b* is provided, the driving force input part 5*a* from which a driving force having a rotary locus can be input is provided at the waste toner accommodating part 2*a* side of the member 5*b*, and the protrusion 5*c* is provided at the image carrier 1 side of the member 5*b*.

In the configuration, when the driving force input part 5*a* of the waste toner conveying member 5 rotates from the location I toward the locations II and III, the driving force input part 5*a* of the waste toner conveying member 5 moves along the rotary locus, but the member 5*b* of the waste toner conveying member 5 moves in the retracting direction toward the waste toner accommodating part 2*a*, and accordingly, the protrusion 5*c* of the waste toner conveying member 5*b* moves in contact with the waste toner along at least a part of the waste toner storage part 2*b*. As a result, the waste toner Td on the waste toner storage part 2*b* is conveyed to the waste toner accommodating part 2*a*.

On the other hand, when the driving force input part 5*a* of the waste toner conveying member 5 rotates from the location III toward the locations IV and I, the driving force input part 5*a* of the waste toner conveying member 5 moves in the advancing direction toward the waste toner storage part 2*b*. At this time, since the protrusion 5*c* of the waste toner conveying member 5*b* moves along at least the part of the waste toner storage part 2*b* without contacting the waste toner, there is no possibility that the waste toner Td on the waste toner storage part 2*b* will turn back toward a direction becoming separated from the waste toner accommodating part 2*a* when the waste toner conveying member 5*b* moves in the advancing direction.

Hereinafter, embodiments of the present invention will be described with reference to the accompanying drawings.

First Embodiment

Entire Construction of Image Forming Apparatus

Figure 2:
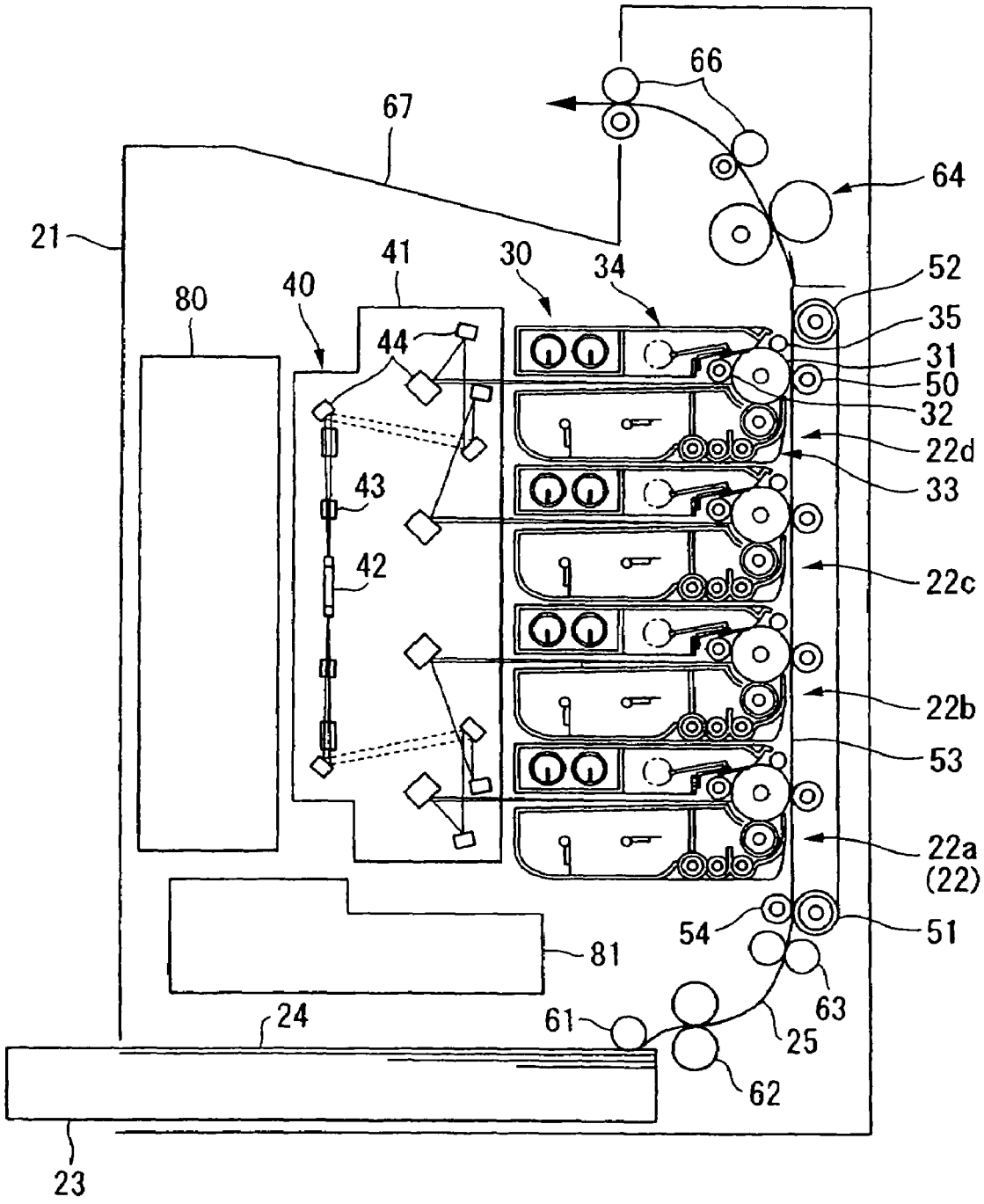
FIG. 2 is an explanatory view showing an image forming apparatus having the cleaning unit built therein according to a first embodiment of the invention.

FIG. 2 shows a first embodiment of an image forming apparatus to which the present invention is applied.

In the drawing, the image forming apparatus is formed as a tandem type color image forming apparatus in which four image forming units 22 (to be specific, 22*a* to 22*d*) having four colors of yellow (Y), cyan (C), magenta (M), and black (K) are longitudinally arranged in a main body 21, a sheet feed cassette 23 for accommodating a stack of sheets 24 for supply is disposed below the image forming units 22, and a sheet conveyance path 25 serving as a conveyance path for the sheet 24 fed from the sheet feed cassette 23 is vertically disposed at places corresponding to each of the image forming units 22.

In this embodiment, the image forming units 22*a* to 22*d* are designed to form toner images of yellow (Y), cyan (C), magenta (M), and black (K) in order from the upstream of the sheet conveyance path 25 to the downstream, and the image forming unit is provided with a unit process cartridge 30 having various kinds of process units built therein and an exposing unit 40 which irradiates scanning light for creating images.

Here, the process cartridge 30 is formed to be integrated with, for example, a photoconductive drum 31, a charging roller 32 for charging the photoconductive drum 31 in advance, a developing unit 33 which develops an electrostatic latent image which is formed on the charged photoconductive drum 33 after being exposed to light by the exposing unit 40 with the corresponding color toner (in negative polarity in this embodiment), a cleaning unit 34 which removes waste toner remaining on the photoconductive drum 31, and an erasing lamp 35 which neutralizes the surface of the charged photoconductive drum 31.

In the meantime, the exposing unit 40 stores semiconductor laser (not shown), a polygon mirror 42, an imaging lens 43 and a mirror 44 in a case 41. The exposing unit 40 deflects beams emitted from the semiconductor laser by the polygon mirror 42, and introduces images of the beams to an exposure point on the photoconductive drum 31 through the imaging lens 43 and the mirror 44.

In the embodiment, a conveyance belt 53 which circulates along the sheet conveyance path 25 is disposed at places corresponding to each photoconductive drum 31 of the respective image forming units 22.

The conveyance belt 53 is formed of materials (rubber or resin) which can electrostatically attract a sheet onto the belt, is stretched over a pair of laying rollers 51 and 52. In this embodiment, the laying roller 52 on the upper side serves as a driving roller, and the laying roller 51 on the lower side serves as a driven roller.

A paper attracting roller 54 is disposed in the entrance part (to which the laying roller 51 faces) of the conveyance belt 53. By applying high voltage for attraction to the sheet attracting roller 54, the sheet 24 is attracted onto the conveyance belt 53. A transfer roller 50 is disposed at the rear side of the conveyance belt 53 corresponding to the photoconductive drum 31 of each image forming unit 22, and thus the sheet 24 on the conveyance belt 53 is closely adhered to the photoconductive drum 31 by the transfer roller 50. A predetermined transfer bias is properly applied between the transfer roller 50 and the photoconductive drum 31 by a transfer bias power source.

A pick-up roller 61 which delivers the sheet 24 at a predetermined timing is provided in the vicinity of the sheet feed cassette 23. The pick-up roller 61 enables the sheet 24 to pass through a conveying roller 62 and a registration roller 63 and to arrive at a transfer position.

A fixing unit 64 is provided in the sheet conveyance path 25 on the downstream of the image forming unit 22*d* arranged at the most downstream position, and a discharging roller 66 for discharging the sheets is provided downstream of the fixing unit 64, and the discharged sheet is accommodated in a discharge tray 67 formed in an upper portion of the main body 21.

In FIG. 2, reference numeral 80 indicates a high voltage power source for supplying a high voltage to a device for high voltage, reference numeral 81 indicates a low voltage power source for supplying a low voltage to a device for low voltage.

The image creating process of such an image forming apparatus is as follows.

Here, as shown in FIG. 2, in each image forming unit 22*a* to 22*d*, the photoconductive drum 31 is charged by the charging roller 32, a latent image is formed on the photoconductive drum 31 by the exposing unit 40, and then a visual toner image is formed by the developing unit 33.

In the meantime, the sheet 24 is fed from the sheet feed cassette 23 by the pick-up roller 61 at a predetermined timing, the sheet 24 passes through the conveying roller 62 and the registration roller 63 and arrives at an attraction position of the conveyance belt 53, and then the sheet 24 is conveyed to a transfer position in a state attracted onto the conveyance belt 53.

Toner images on the photoconductive drums 31 in each image forming unit 22 are respectively transferred onto the sheet 24 by the transfer roller 50, unfixed toner images of each color component are fixed on the sheet 24 by the fixing roller 64, and then the sheet 24 on which toner images are fixed is discharged to the discharge tray 67.

Outline of Process Cartridge

Figure 3:
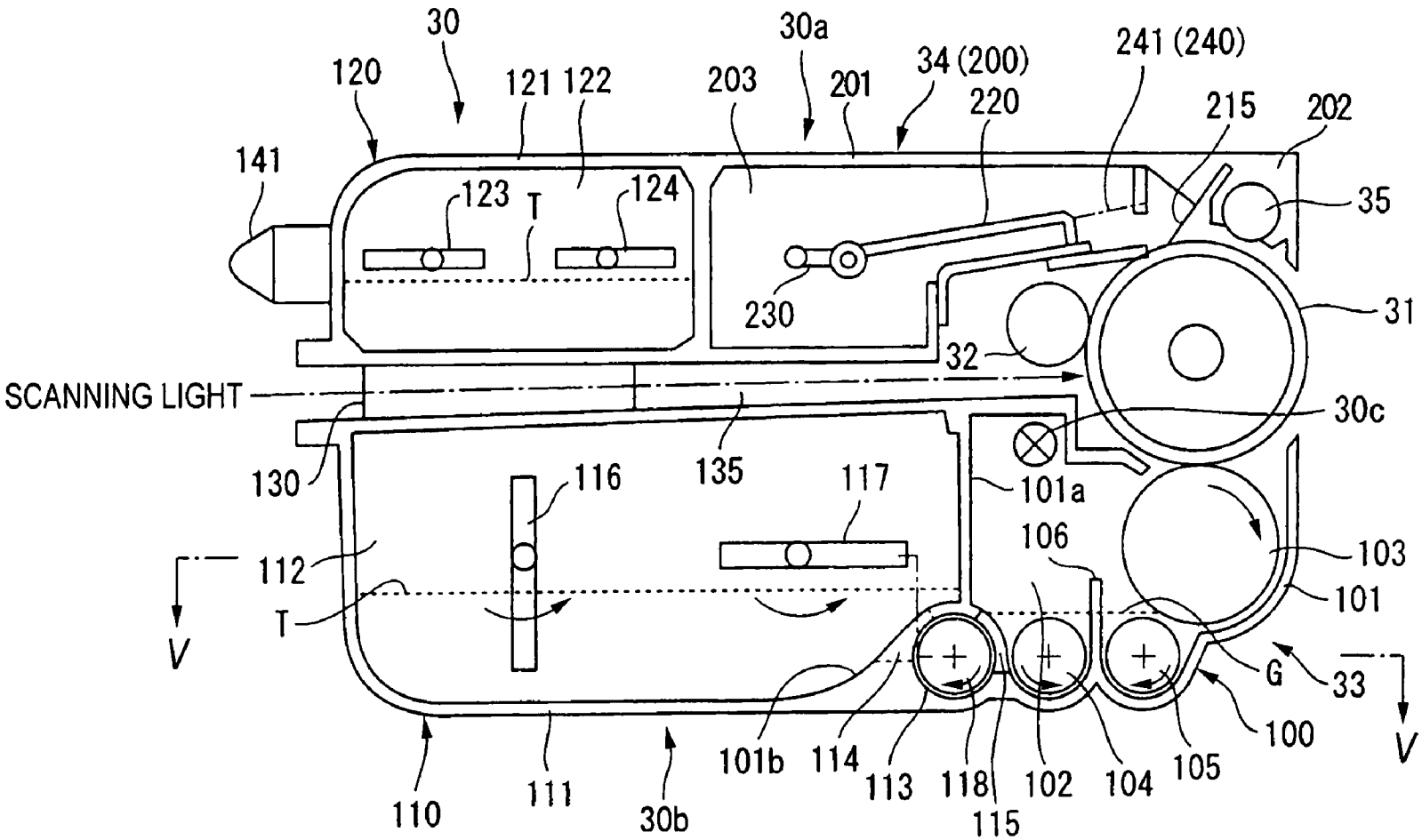
FIG. 3 is an explanatory view showing a process cartridge to be used in the embodiment in detail.

FIG. 3 shows the process cartridge 30 used in this embodiment in detail.

In the drawing, the process cartridge 30 is provided with a photoconductive cartridge 30*a* and a development cartridge 30*b*, besides the photoconductive drum 31, the charging roller 32, parts of the developing unit 33, and the cleaning unit 34. The photoconductive cartridge 30*a* includes the erasing lamp 35 which serves as a device neutralizing the photoconductive drum 31 before a cleaning process. The development cartridge 30*b* is provided below the photoconductive cartridge 30*a* so as to be rockable with respect to the photoconductive cartridge 30*a*, and includes essential parts of the developing unit 33.

In particular, in this embodiment, the developing unit 33 is provided with a developing unit 100 and toner supply units 110 and 120. The developing unit 100 disposed to face the photoconductive drum 31 visualizes an electrostatic latent image on the photoconductive drum 31 with a development agent G made of a toner and a carrier. The toner supply units 110 and 120 (a main toner supply unit 110 and a sub toner supply unit 120 in this embodiment) supply a toner T to the developing unit 100.

The photoconductive cartridge 30*a* is formed to be integrated with a cleaning unit 200 and the sub toner supply unit 120 arranged in a horizontal direction. The cleaning unit 200 is formed by making the cleaning unit 34 into one unit. The development cartridge 30*b* is formed by integrating the developing unit 100 and the main toner supply unit 110 arranged in the horizontal direction.

In this embodiment, the development cartridge 30*b* is rockable with respect to the photoconductive cartridge 30*a* by a pivot shaft 30*c*. The photoconductive cartridge 30*a* is positioned and fixed in the main body 21. The pivot shaft 30*c* is located in the vicinity of the developing unit 100. A scan path 135 through which scanning light emitted from the exposing unit 40 can pass is secured between the photoconductive cartridge 30*a* and the development cartridge 30*b*. A spacer 130 composed of an elastic member is interposed between both sides of an entrance part of the scan path 135, that is, the respective parts of the cartridges 30*a* and 30*b*, so that the developing cartridge 30 is pressingly urged with respect to the photoconductive cartridge 30*a*. In addition, instead of the spacer 130, urging elements such as an urging spring can be used.

Figure 4A:
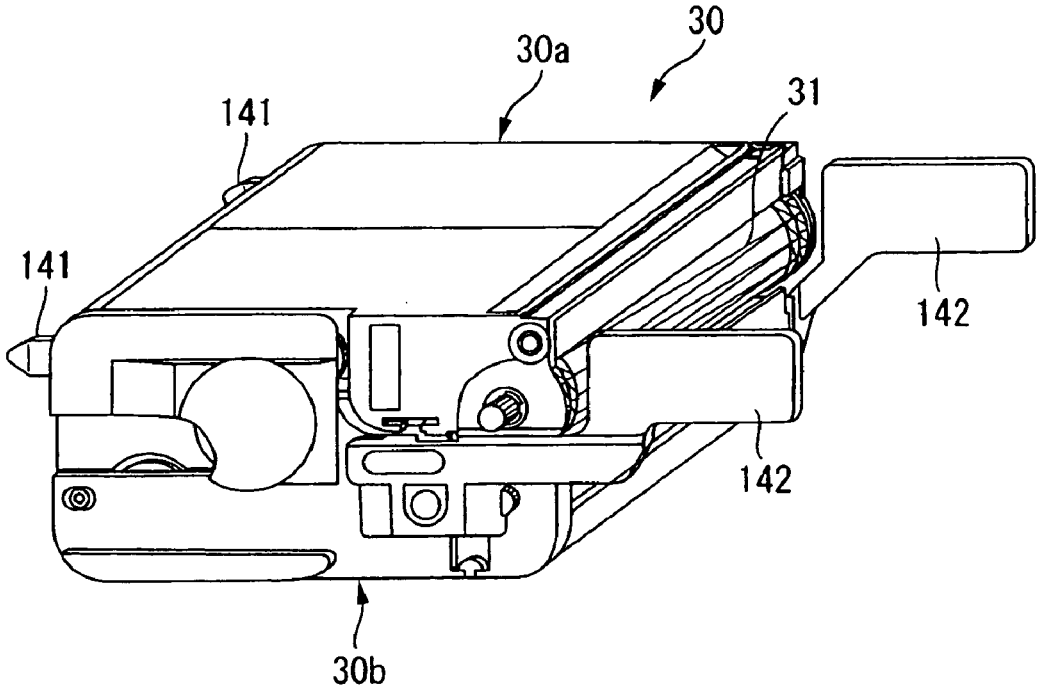
FIG. 4A is a view of the process cartridge to be used in the embodiment taken along one direction.
Figure 4B:
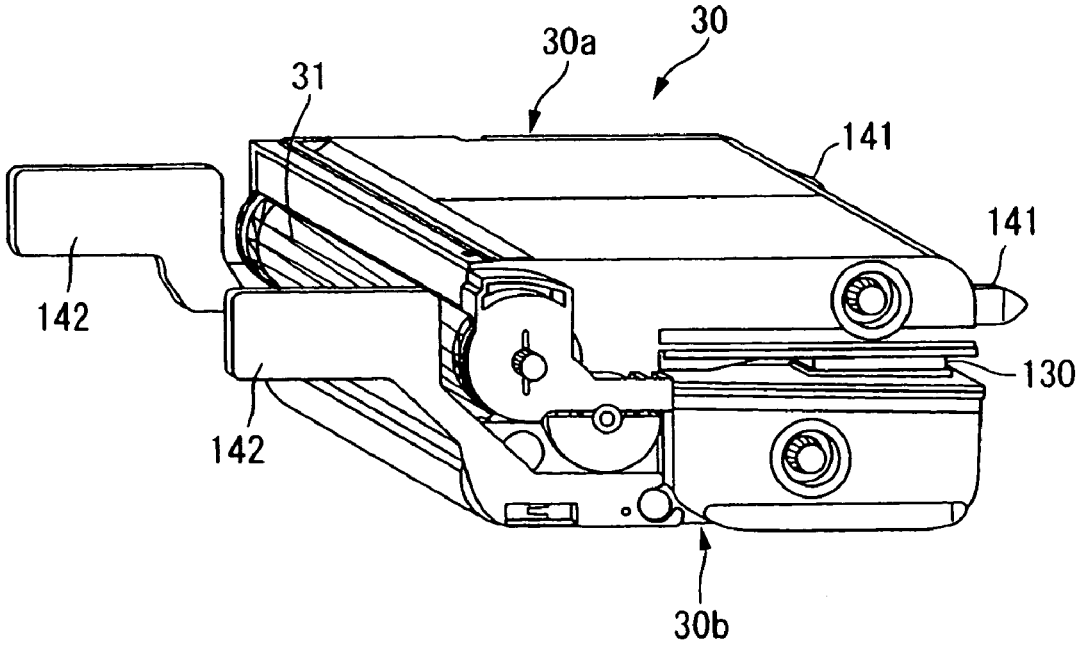
FIG. 4B is a view of the process cartridge to be used in the embodiment taken along the other direction.

In this embodiment, for example, a pair of supporting protrusions 141 are provided in the sub toner supply unit 120 of the photoconductive cartridge 30*a*, as shown in FIG. 3 and FIGS. 4A and 4B. The pair of supporting protrusions 141 extend in a direction orthogonal to the axis direction of the photoconductive drum 31.

When the process cartridge 30 is mounted in a cartridge supporting part (not shown) of the main body 21, both ends of the supporting shaft of the photoconductive drum 31 are fixed to predetermined locations by a fixing accommodation member (not shown) provided in the cartridge supporting part, and a drive transfer member (drive transfer gear) disposed at one end of the photoconductive drum 31 is connected to and engaged with a driving system (not shown) provided in the cartridge supporting part. The drive transfer member is rotatably disposed about the supporting shaft. In addition, the pair of supporting protrusions 141 are engaged with an engaged part (concave part or hole) of the cartridge supporting part, such that the photoconductive cartridge 30*a* is positioned and fixed in the main body 21. Here, the cartridge supporting part of the main body 21 can be used as long as the cartridge supporting part can accommodate and support the process cartridge 30. Thus, the main body frame itself can be used as the cartridge supporting part, and the cartridge supporting part can be formed by providing an additional member to the main body frame.

Particularly, in the embodiment, the supporting protrusion 141 is provided on an outer wall side of the cleaning unit separated from the photoconductive drum 31, and is positioned with respect to a direction different from the shaft direction of the photoconductive drum 31. Therefore, the supporting protrusion 141 can stably support the photoconductive cartridge 30*a*. In addition, the supporting protrusion is provided in pair, and four supporting points of the photoconductive cartridge 30*a* are provided so as to decrease the load applied on each of the four points by the process cartridge 30, and to correct distorted deformation of the process cartridge 30.

In addition, in FIG. 4, reference numeral 142 indicates a grip arm to be used in attaching and detaching the process cartridge 30.

Developing Unit

Each unit 100, 110 and 120 constituting the developing unit 33 used in the embodiment will be described.

Developing Unit

Figure 5:
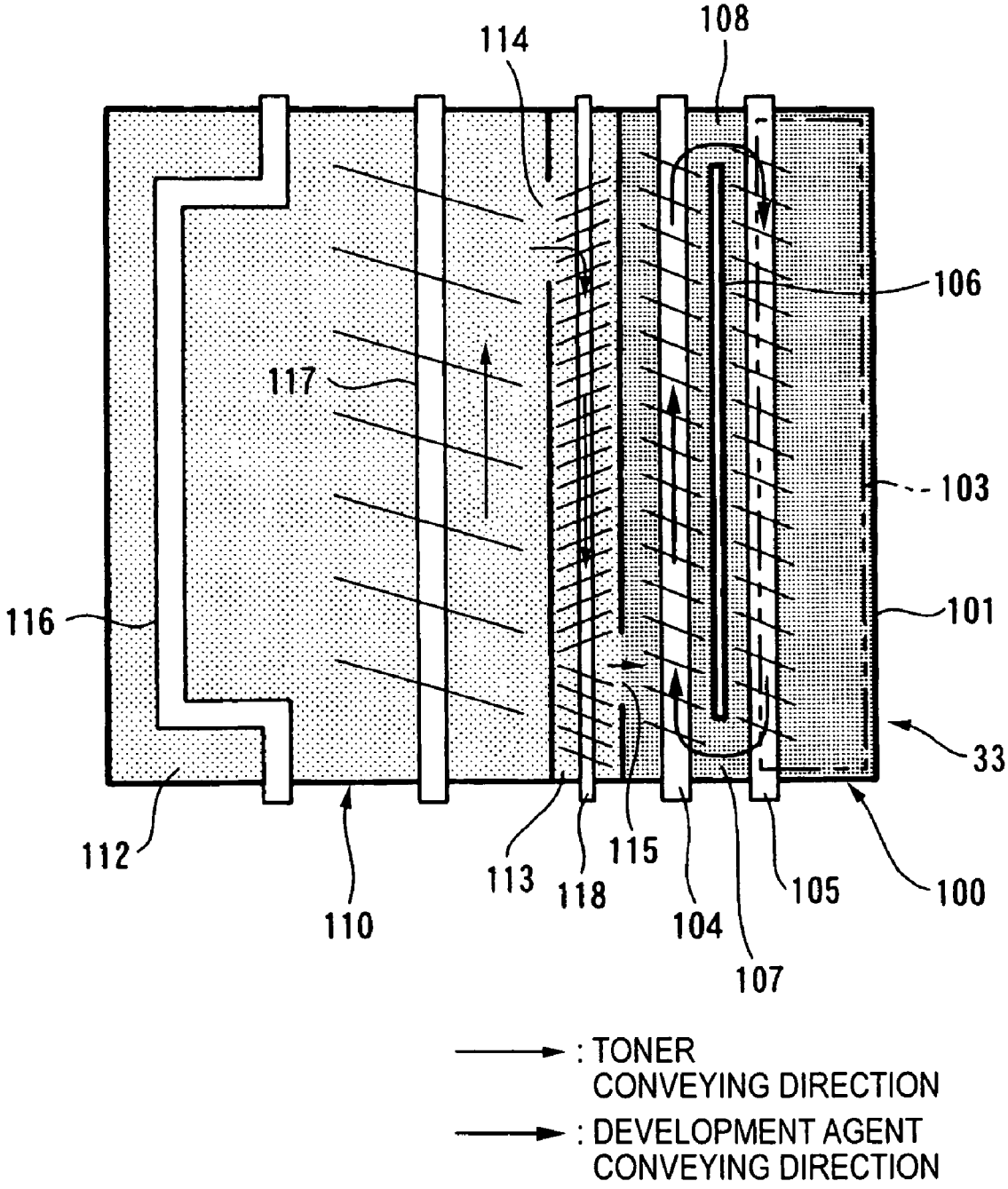
FIG. 5 is a partially cutaway view of a development cartridge.

In this embodiment, as shown in FIGS. 3 to 5, the developing unit 100 adopts a two-component development system. The developing unit 100 is provided with a development housing 101 below the photoconductive drum 31 which is open to the photoconductive drum 31, and a development agent accommodating chamber 102 for accommodating a development agent G made of toner and carrier. The development agent accommodating chamber 102 is formed as the inside of the developing housing 101. A development roller 103 for carrying the development agent is disposed in a region facing an opening of the development housing 101. The development unit 100 divides the development agent accommodating chamber 102 into two parts by a partition wall 106 which extends along an axis direction of the development roller 103, communication openings 107 and 108 are formed at both ends of the partition wall 106 in a longitudinal direction, thus constituting a circulation path of the development agent in the development agent accommodating chamber 102. A pair of agitation carrying augers 104 and 105 are disposed in the circulation path of the development agent in the axis direction of the development roller 103 so as to carry the development agent G while agitating the development agent G in the circulation path of the development agent.

In addition, in this embodiment, even though the agitation carrying auger 105 that is close to the development roller 103 concurrently supplies the development agent to the development roller 103, it is needless to say that a development agent supply member (such as a roller and a paddle) can be added in addition to the agitation carrying auger 105. Further, a trimming member for regulating the thickness of a development agent layer and a collecting member for collecting any unused development agent are provided in the vicinity of the development roller 103, if needed.

Main Toner Supply Unit

As shown in FIGS. 3 to 5, the main toner supply unit 110 has a main supply housing 111 which shares a rear face wall on the depth side of the development housing 101 with the development unit 100. A toner supply chamber is formed as the inside of the main supply housing 111 so as to accommodate the toner T and to supply the toner.

In particular, in this embodiment, the toner supply chamber is divided into a toner accommodating chamber 112 and a dispense chamber 113. The toner accommodating chamber 112 accommodates the supplying toner T. The dispense chamber 113 communicates with the toner accommodating chamber 112 and quantitatively supplies the toner T to the development unit 100. Here, the dispense chamber 113 is provided with a thick-wall part below a barrier wall 101*a* on the depth side of the development housing 101, and the dispense chamber 113 is formed as a substantially circular (in a cross-sectional view) path elongated in the axis direction of the development roller 103 in the thick-wall part 101*b*.

A dispense entrance aperture 114 is formed at a region, on the depth side of the thick-wall part 101*b* in the longitudinal direction, facing the toner accommodating chamber 112, and a toner supply opening 115 is formed at a region of the thick-wall part 101*b* facing the dispense chamber 113, that is, at the side opposite to the dispense entrance aperture 114 in the longitudinal direction.

An agitator 116 and an agitator 117 are disposed in the toner accommodating chamber 112. The agitator 116 agitates the supplying toner T and conveys the toner, and the agitator 117 agitates the toner T which is agitated and conveyed by the agitator 116 and conveys the toner to the dispense entrance aperture 114 of the dispense chamber 113. FIG. 5 schematically shows the agitators 116 and 117.

In the meantime, a dispense auger 118 is disposed along the longitudinal direction in the dispense chamber 113. In particular, in this embodiment, the dispense auger 118 has a spiral blade having a diameter as substantially the same as that of the agitation carrying augers 104 and 105 in the developing unit 100

In this embodiment, the toner supply opening 115 is formed such that a lower end thereof is located below the surface of the development agent G to be accommodated in the development agent accommodating chamber 102. That is, the toner supply aperture 115 should be covered at least by the surface of the development agent G of the development agent accommodating chamber 102, and the supplying toner T can be supplied to a development agent collection part of the development agent accommodating chamber 102 from the side, so that the mixability of the supplying toner T can be ensured.

In this case, when the pressure by which the supplying toner T from the dispense chamber 113 is extruded from the toner supply opening 115 is larger than an internal pressure applied by the development agent G in the development agent accommodating chamber 102, the supplying toner T can be stably supplied even though the toner supply opening 115 faces a region located lower than the surface of the development agent.

Particularly, when a lower end of the toner supply opening 115 is disposed below the rotational center of the agitation carrying auger 104, the toner T is supplied from a region lower than the rotational center of the agitation carrying auger 104. Therefore, the supplied toner T is deposited into the agitation carrying auger 104 so that the toner T is rapidly agitated and mixed with the development agent.

The dispense entrance aperture 114 may be properly formed. However, due to an internal pressure of the toner in the dispense chamber 113 needing sufficient pressure increase, the dispense entrance aperture 114 is preferably larger than the toner supply opening, and the conveyance length for the supplying toner T of the dispense chamber 113 is preferably much longer than the dispense entrance aperture 114.

In regards to the diameter dimension, the blade pitch, the number of rotation, etc. of the dispense auger 118, the internal pressure of the toner which depends on the conveyance force of the toner by the dispense auger 118 is set larger than the internal pressure (which depends on conveyance force of the agitation carrying auger 104) of the development agent G in the development agent accommodating chamber 102 applied to the toner supply opening 115.

At this time, in this embodiment, the diameter dimension of the dispense auger 118 is substantially the same as that of the agitation carrying augers 104 and 105. However, by making the diameter dimension of the dispense auger 118 smaller than that of the agitation carrying augers 104 and 105, consistent supply of toner supply can be ensured.

In respect of the capacity of the toner accommodating chamber 112, when the capacity of the toner accommodating chamber 112 is made larger than the capacity of the dispense chamber 113 and the development agent accommodating chamber 102 combined, toner can be consistently supplied. The capacity referred here means the capacity of toner and the capacity of development agent, respectively.

In this embodiment, the rotational center of the agitators 116 and 117 is disposed at places higher than the dispense auger 118 and the agitation carrying augers 104 and 105.

For this reason, since it is unnecessary to raise the toner T from the toner accommodating chamber 112 to the dispense chamber 113 and the development agent accommodating chamber 102, the internal pressure of the toner in the dispense chamber 113 can be effectively increased. Thus, without affecting the internal pressure of the toner in the dispense chamber 113, the toner can be easily supplied to the development agent accommodating chamber 102.

Sub Toner Supply Unit

In this embodiment, as shown in FIG. 3, the sub toner supply unit 120 includes a sub supply housing 121 which is adjacent to the rear side of the cleaning unit 200. A toner supply chamber 122, in which the supplying toner T is accommodated so as to be suppliable thereto, is formed as the inside of the sub supply housing 121.

A pair of agitators 123 and 124 are disposed in the toner supply chamber 122, the agitators are for agitating and conveying the supplying toner T.

Here, a communication structure between the sub toner supply unit 120 and the main toner supply unit 110 is formed by forming a communication path (toner supply path 131) in the spacer 130 made of elastic materials. In this embodiment, the spacer 130 is provided at two places at both sides between the respective units 110 and 120, and the toner supply path 131 is respectively formed. However, for example, the toner supply path 131 may be formed in one of the spacers 130. Otherwise, the spacer 130 may be provided at one place, and the toner supply path 131 may be formed in this spacer 130.

Figure 6:
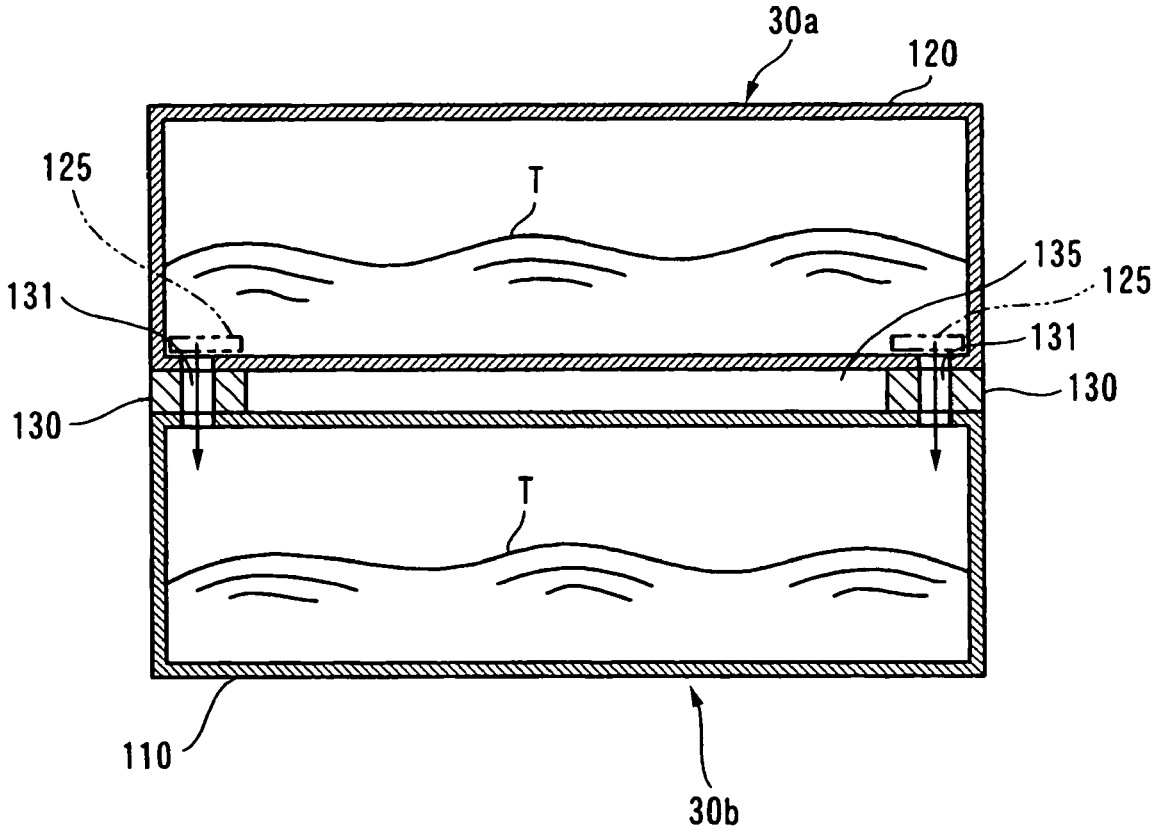
FIG. 6 is an explanatory view showing a communication structure of a main toner supply unit and a sub toner supply unit.

In this embodiment, as indicated by a virtual line in FIG. 6, the sub toner supply unit 120 preferably covers parts connected to the toner supply path 131 with a sealing member 125 in a non-using state, and the sealing member 125 is openable in a using state. In this case, it is unlikely that the toner in the sub toner supply unit 120 will get into the toner supply path 131 when the process cartridge 30 is not being used (for example, during transportation), nor cause clogging. Further, it is unlikely that the toner in the sub toner supply unit 120 is filled in a state inclined toward the main toner supply unit 110 so that the filling density of the toner in the main toner supply unit 110 is unnecessarily increased.

In this embodiment, when a predetermined amount of toner T is supplied to the developing unit 100 from the main toner supply unit 110, the toner T in the sub toner supply unit 120 is added into the main toner supply unit 110. For this reason, a predetermined amount of toner T is filled in the main toner supply unit 110 until the sub toner supply unit 120 becomes empty. Therefore, weight changes of the development cartridge 30*b* are suppressed to be small.

At this time, since the photoconductive cartridge 30*a* is positioned and fixed to the cartridge supporting part of the main part 21, changes in the capacity of the toner in the sub toner supply unit 120 never affects the weight changes of the development cartridge 30*b*. Therefore, changes in urging force of the development cartridge 30*b* applied to the photoconductive cartridge 30*a* are suppressed until the sub toner supply unit 120 becomes empty. Thus, images can be effectively prevented from deteriorating as much as the changes are suppressed.

Since the photoconductive cartridge 30*a* is positioned and fixed to the main body 21, the location of a bottom face of the photoconductive cartridge 30*a* which forms the scan path 135 is not likely to change. Therefore, even though the location of the development cartridge 30*b* which is rockably supported in the photoconductive cartridge 30*a* changes, it is unlikely that the scan path 35 will be affected.

Cleaning Unit

Figure 7:
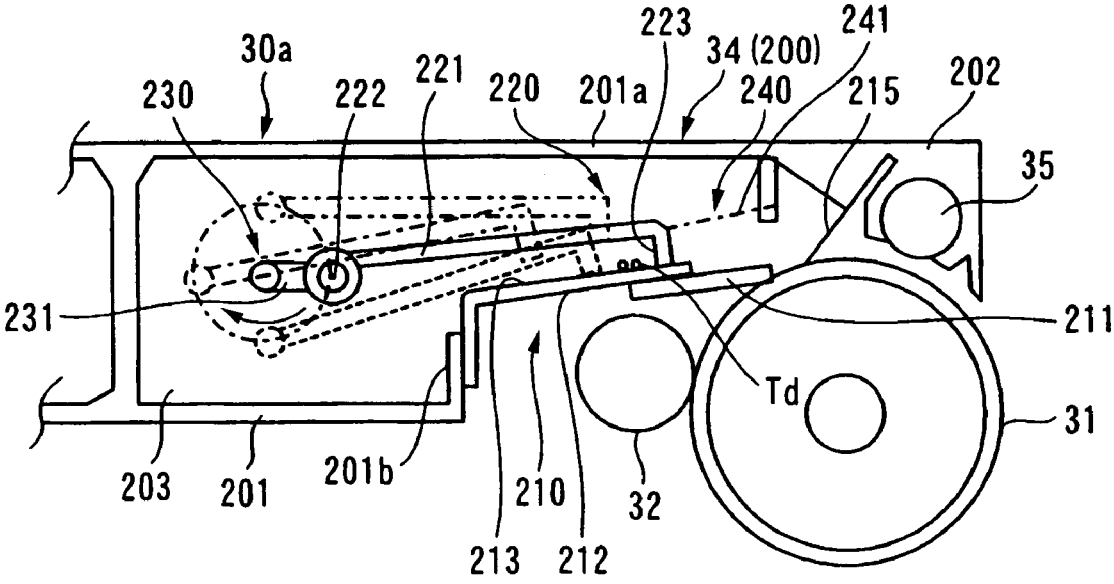
FIG. 7 is an explanatory view of essential parts of the cleaning unit to be used in the embodiment.
Figure 8:
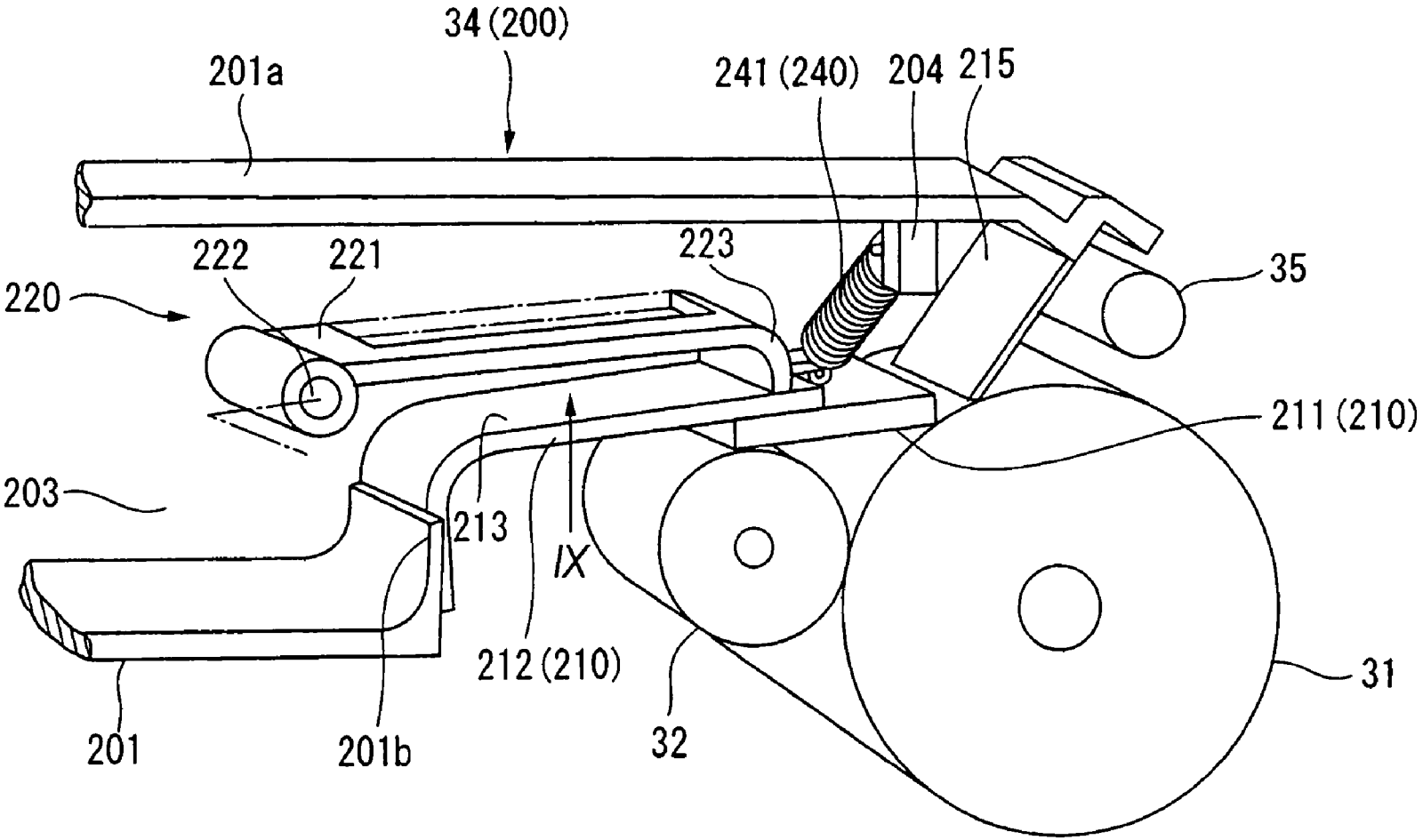
FIG. 8 is a perspective view of essential parts partially cut away from the cleaning unit to be used in the embodiment.
Figure 9:
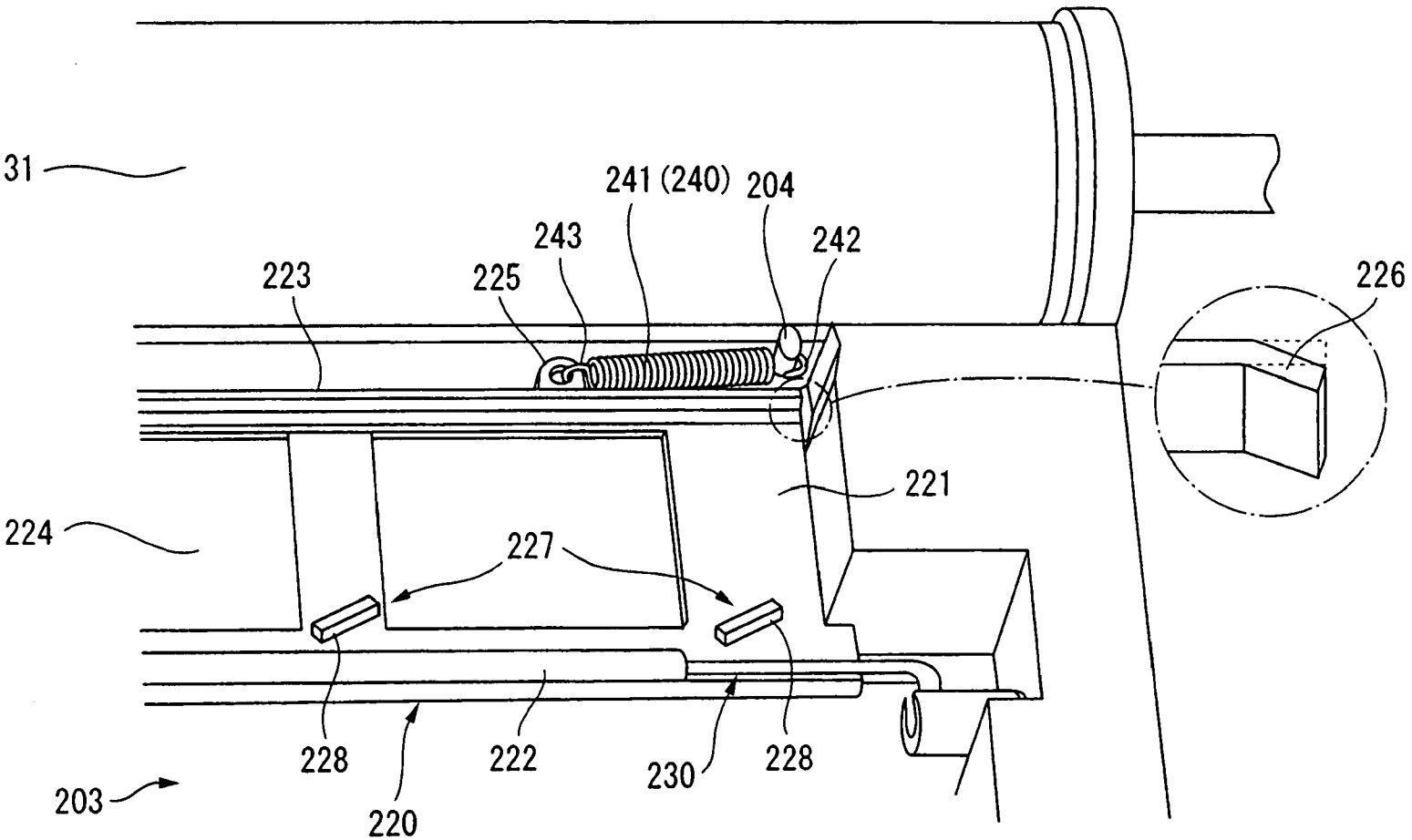
FIG. 9 is a view taken along the line IX of FIG. 8.

In this embodiment, as shown in FIGS. 7 to 9, the cleaning unit 34 is built in the photoconductive cartridge 30*a* as the cleaning unit 200.

The cleaning unit 200 includes the cleaning housing 201 which is open to the photoconductive drum 31 in a state facing the photoconductive drum 31. A waste toner accommodating chamber 203 capable of accommodating waste toner is formed as the inside of the cleaning housing 201, and an upper wall 201*a* of the cleaning housing 201 is formed in a cover shape which covers the photoconductive drum 31 by extending the upper wall 201*a* toward the photoconductive drum 31.

A cleaning blade 210 is disposed at a lower edge part 201*b* of the opening of the cleaning housing 201. In The cleaning blade 210, a substantially L-shaped blade holder 212 is mounted on the lower edge part 201*b* of the opening of the cleaning housing 201 and a side wall part (not shown) perpendicularly drooping from both sides of the upper wall 201*a*, and a blade main body 211 made of an elastic body such as urethane rubber is mounted on the outside of a front end of the blade holder 212. The front end of the blade main body 211 is elastically in contact with the photoconductive drum 31 such that the front end goes against the rotational direction (counter-clockwise direction in FIG. 7) of the photoconductive drum 31.

In the meantime, a film seal 215 such as polyurethane is provided at a upper edge part (in the vicinity of the front end of the upper wall 201*a* in this embodiment) of the opening of the cleaning housing 201, and a front end of the film seal 215 is elastically in contact with the photoconductive drum 31 along the rotational direction of the photoconductive drum 31, so that waste toner collected by the cleaning blade 210 is prevented from dispersing.

In this embodiment, parts other than the mounting part of the cleaning housing 201 to which the cleaning blade 210 is mounted are disposed substantially parallel to the cover shaped part of the upper wall 201*a* of the cleaning housing 201, and are formed as a waste toner storage part 213 (equivalent to an inner face of the blade holder 212) which temporarily collects the waste toner that is scraped off by the cleaning blade 210. Particularly, in the embodiment, the waste toner storage part 213 is declined toward the waste toner accommodating chamber 203. Thus, conveyance properties of the waste toner Td can be improved.

In this embodiment, even though the waste toner storage part 213 is formed by the cleaning blade 210 alone, the waste toner storage part 213 can be formed by not only using the cleaning blade 210 but also parts of the cleaning housing 201.

Since a space which is concave toward the photoconductive drum 31 is secured between the cleaning housing 201 and the cleaning blade 210, the charging roller 32 is disposed by using this concavity.

A holding block 202 of the erasing lamp 35 is provided at the front end of the upper wall 201*a* of the cleaning housing 201.

In the embodiment, a waste toner conveying member 220 is provided in the cleaning housing 201, the waste toner conveying member 220 conveys the toner scraped off by the cleaning blade 210 to the waste toner accommodating chamber 203.

The waste toner conveying member 220 includes a conveyance plate 221 which serves as a member stretching over from the waste toner accommodating chamber 203 to the waste toner storage part 213, A drive input part 222 capable of inputting external driving force is provided at an end of the conveyance plate 221 on the waste toner accommodating chamber 203 side, and a protrusion 223 capable of contacting the waste toner storage part 213 is provided at the other end of the conveyance plate 221 on the photoconductive drum 31 side.

Here, the conveyance plate 221 may be formed in a plate shape. However, in consideration of reducing weight and the fact that waste toner should be effectively prevented from being collected in an upper part of the conveyance plate 221, an aperture 224 is preferably formed in a region other than the protrusion 223 and the drive input part 222 of the conveyance plate 221. In addition, it is unnecessary for the protrusion 223 to be formed at the end of the conveyance plate 221, and the protrusion 223 may be formed at places away from the end of the conveyance plate 221. Further, even though only one protrusion 223 is sufficient, a plurality of the protrusions 223 may be provided. As a method of forming the protrusion 223, the protrusion 223 may be formed by bending a front end of the conveyance plate 221. Otherwise, the protrusion 223 may be integrally formed with a part of the conveyance plate 221, or may be formed separate from the conveyance plate 221.

Figure 19A:
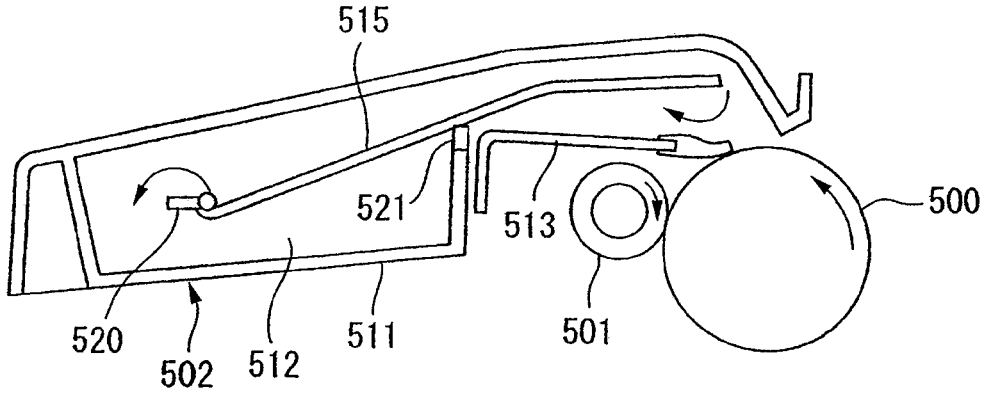
FIG. 19A Related Art
FIG. 19A is an explanatory view showing an example of a conventional cleaning unit.
Figure 19B:
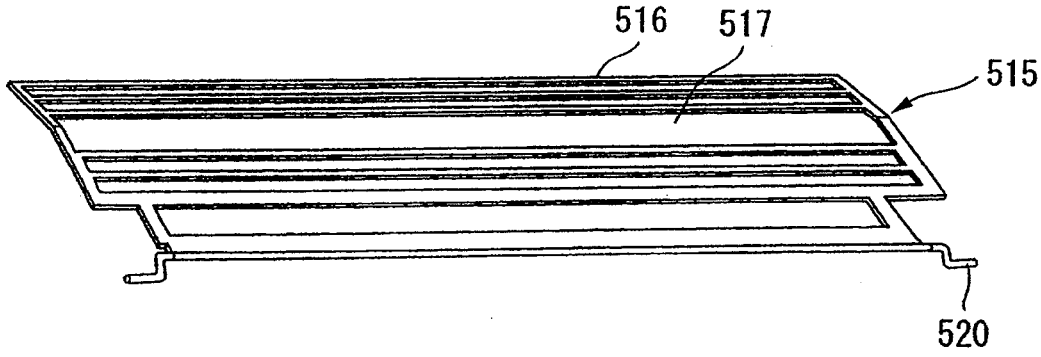
FIG. 19B Related Art
FIG. 19B is an explanatory view showing an example of a waste toner conveying member.

It is unnecessary for the conveyance plate 221 to serve as a member of the waste toner conveying member 220. For example, a frame structure as shown in FIG. 19B may be used as the member of the waste toner conveying member 220.

In the embodiment, as shown in FIG. 7 and FIG. 9, the waste toner conveying member 220 includes guide auxiliary parts 226 and 227 which can guide and convey waste toner toward a width direction orthogonal to an advancing/retracting direction.

In this example, the guide auxiliary part 226 is formed by disposing both ends in a width direction of the protrusion 223 of the waste toner conveying member 220 in a direction inclined toward the retracting direction of the waste toner conveying member 220, for example, the guide auxiliary part 226 can be formed by bending parts of a member constituting the protrusion 223 in the inclination direction.

The guide auxiliary part 226 pushes the waste toner on the waste toner storage part 213 to the vicinity of the center in the width direction when the waste toner conveying member 220 moves in the retracting direction. Accordingly, the waste toner overflows from both ends in the width direction of the waste toner conveying member 220, and thereby effectively preventing an end seal of the cleaning blade 210 from being subject to excessive pressure.

The guide auxiliary part 227 is provided in the vicinity of the drive input part 222 on the rear face of the conveying plate 221 of the waste toner conveying member 220. A plurality of rod shaped blocks 228 is disposed inclined at a predetermined gap, so that the rod shaped block 228 pushes the waste toner in the waste toner accommodating chamber 203 to both sides in a longitudinal direction (width direction) of the waste toner accommodating chamber 203. In this embodiment, the rod shaped blocks 228 are symmetrically arranged with respect to a boundary line that is a central part of the waste toner conveying member 220.

In the embodiment, since both ends of the drive input part 222 of the waste toner conveying member 220 are disposed in a state extending outward further than the width dimension of the cleaning member 210 (see FIG. 7), a space in the width direction of the waste toner accommodating chamber 203 is set larger than the width dimension of the cleaning member 210 (see FIG. 9). Therefore, in the embodiment, since the guide auxiliary part 227 pushes waste toner to the outside of both ends in the width direction of the waste toner accommodating chamber 203 when the waste toner conveying member 220 moves in the retracting direction, the waste toner can be effectively filled in the space between both sides in the width direction of the waste toner accommodating chamber 203.

In the embodiment, for example, as shown in FIGS. 7 to 9, drive force having a rotating locus is input into the drive input part 222 of the waste toner conveying member 220, and the driving force having a rotating locus can be easily obtained by rotatingly driving a crank shaft 231 that is a kind of a rotation drive mechanism 230 about the rotational center of the crank shaft 231.

Particularly, in the embodiment, when the drive force is applied to the drive input part 222 in the rotational direction, the waste toner accommodated in the waste toner accommodating chamber 203 is pushed in a direction separated from the cleaning blade 210. Therefore, filling efficiency of the waste toner to be filled in the waste toner accommodating chamber 203 can be improved, and thus the space of the waste toner accommodating chamber 203 can be efficiently used.

In the embodiment, a position regulating mechanism 240 is installed in the waste toner conveying member 220, the position regulating mechanism 240 regulates moving positions of the waste toner conveying member 220.

In the embodiment, the position regulating mechanism 240 is formed by an urging spring 241 whose one end is engaged with the protrusion 223 of the waste toner conveying member 220 and the other end is engaged with a part of the cleaning housing 201. The position regulating mechanism 240 urges the waste toner conveying member 220 in a direction separated from the drive input part 222.

Particularly, in the embodiment, the urging spring 241 is disposed in a direction inclined to the retracting direction of the waste toner conveying member 220.

Here, as for an installing structure of the urging spring 241, as shown in FIGS. 7 to 10, engaging hooks 242 and 243 are provided at both ends of the urging spring 241, one engaging hook 242 is engaged with an engaging protrusion 204 on the cleaning housing 201 side, and the other engaging hook 243 is engaged with an engaging piece 225 provided at one end on the protrusion 223 side of the waste toner conveying member 220.

In the embodiment, even though a mounting structure of the urging spring 241 is formed such that the engaging protrusion 204 is provided in the cleaning housing 201, the mounting structure is not limited to this structure. For example, in a structure in which an external communicating engaging hole is formed in the cleaning housing 201, waste toner is likely to leak. However, the engaging hole can be sealed by a sealing member. As the sealing material, things which serve also as a label to be attached to CRU are preferably used.

In this way, when the urging spring 241 is installed in the waste toner conveying member 220, as shown in FIGS. 7 to 10, when the drive force having rotating locus is input to the drive input part 222 of the waste toner conveying member 220, following the rotation, the protrusion 223 of the waste toner conveying member 220 moves in the retracting direction along with the waste toner storage part 213.

At this time, the urging spring 241 regulates the range of the positional changes of the waste toner conveying member 220 corresponding to positional changes of the drive input part 222 of the waste toner conveying member 220.

Figure 11:
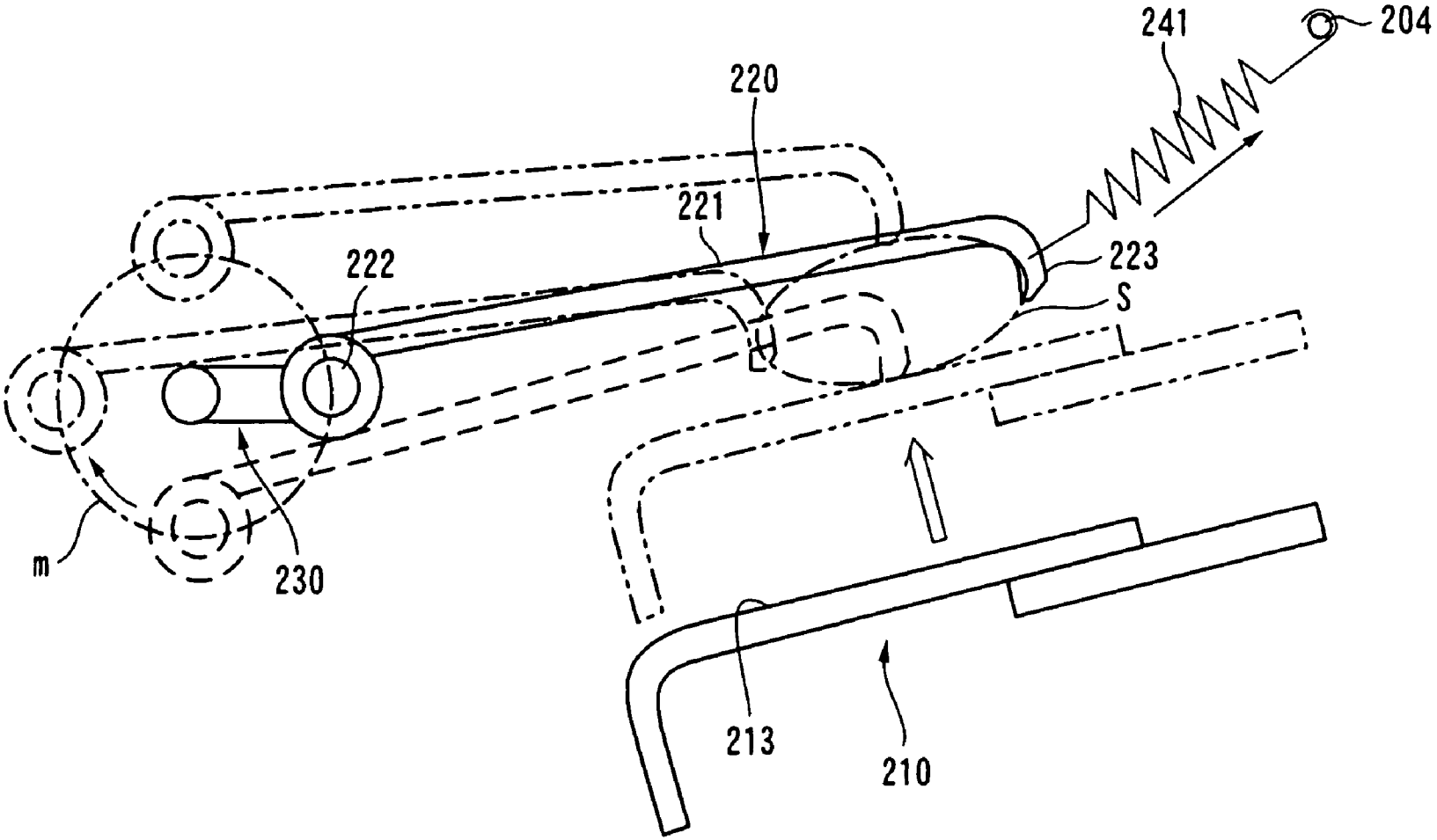
FIG. 11 is an explanatory view schematically showing movement of the waste toner conveying member in the embodiment.

That is, as shown in FIG. 11, the waste toner conveying member 220 follows such that the drive input part 222 draws a rotating locus (circular locus) by the rotation drive mechanism 230, and accompanying to the rotation, the protrusion 223 of the waste toner conveying member 220 draws an elliptic locus s which is flat in the horizontal direction by the urging operation of the urging spring 241. As the cleaning blade 210 is positioned and disposed in a predetermined position with respect to the photoconductive drum 31, taking the elliptic locus s of the protrusion 223 into account, the moving locus of the protrusion 23 of the waste toner conveying member with respect to the waste toner storage part 213 is defined. In this example, when the waste toner conveying member 220 moves in the retracting direction, the protrusion 223 moves along the waste toner storage part 213 in a state of contact with waste toner, and when the waste toner conveying member 220 moves in the advancing direction, the protrusion 223 moves in a state of no contact with the waste toner on the waste toner storage part 213.

At this time, by setting the relative positional relationship between the elliptic locus s of the protrusion 223 and the cleaning blade 210, how much the waste toner conveying member 220 moves in contact with or not in contact with the waste toner on the waste toner storage part 213 when the waste toner conveying member 220 moves in the advancing/retracting direction is defined.

By setting the strength of the urging spring 241, the distance from a virtual line of the drive input part 222 and the engaging protrusion 204 to the front end of the protrusion 223 can be defined.

Figure 10B:
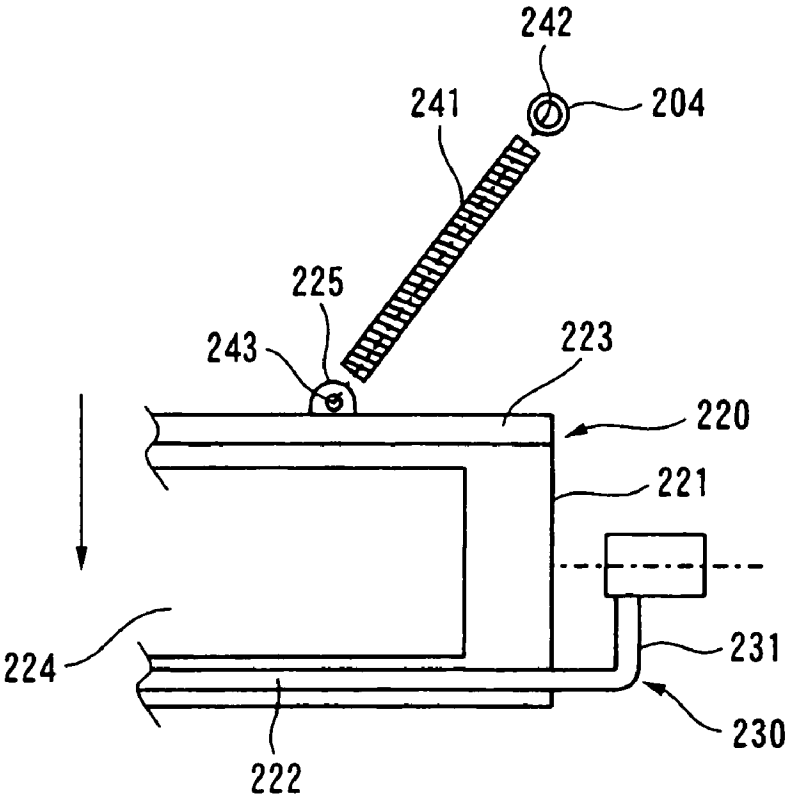
FIGS. 10A and 10B are explanatory views showing an operation state of an urging spring when the waste toner conveying member moves in an advancing/retracting direction.
Figure 10A:
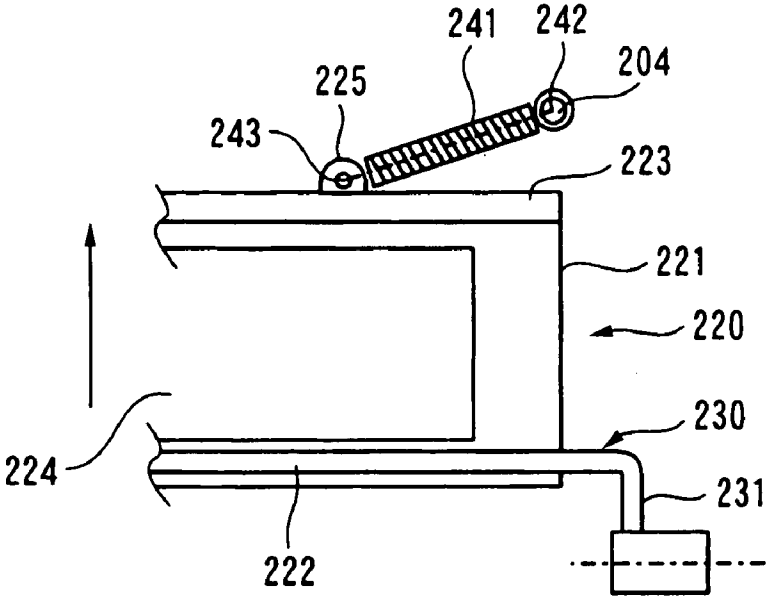

Particularly, in this embodiment, as showing in FIGS. 10A and 10B, since the urging spring 241 is disposed inclined to the advancing/retracting direction of the waste toner conveying member 220, a space for disposing can be saved. In addition, the amount of expansion and contraction of the urging spring 241 with respect to the amount of movement of the waste toner conveying member 220 can be set small. Thus, as the amount of expansion and the contraction is set small, changes in the drive force to be applied to the waste toner conveying member 220 can become moderate. In this respect, it is preferable.

In the embodiment, as shown in FIG. 7 to FIG. 11, since the urging direction of the urging spring 241 is disposed more inclined to the vertical direction than an inclined face of the waste toner storage part 213, the front end of the protrusion 223 of the waste toner conveying member 220 droops due to the urging spring 241. Thus, when the waste toner conveying member 220 moves in the retracting direction, the protrusion 223 of the waste toner conveying member 220 can scrape off the waste toner on the waste toner storage part 213 while the protrusion 223 is slightly in contact with or not in contact with the waste toner storage part 213. For this reason, while waste toner is being collected by the waste toner conveying member 220, the cleaning blade 210 is not necessarily affected by the vibration.

Next, the operation of the cleaning unit 34 to be used in this embodiment will be described.

Figure 12A:
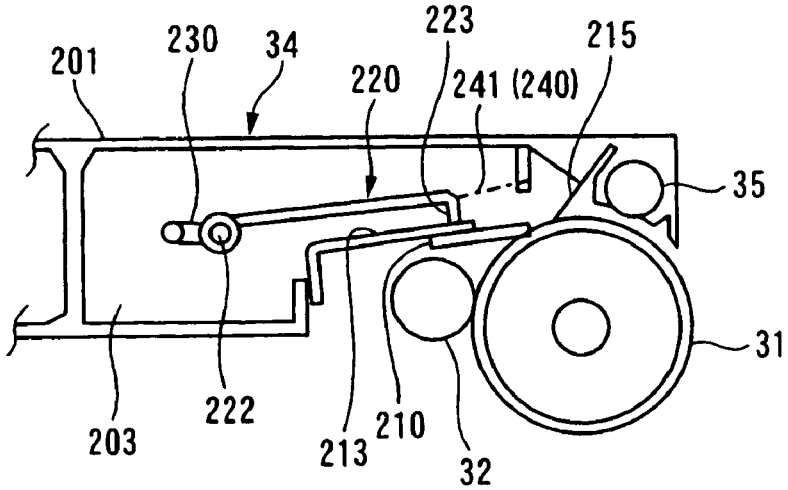
FIGS. 12A to 12C are views showing operation states of the cleaning unit according to the first embodiment when the waste toner conveying member moves in the retracting direction.

Here, as shown in FIGS. 7 and 12A, when residual toner on the photoconductive drum 31 is scraped off and collected by the cleaning blade 210, the scraped and collected waste toner Td is collected on and around the cleaning blade 210. However, the scraped and collected waste toner is sequentially pushed out, and the waste toner Td is then collected on the waste toner storage part 213 (equivalent to an inner face of the blade holder 212).

When the conditions are like this, when the drive input part 222 of the waste toner conveying member 220 is positioned as shown in FIG. 12A, the waste toner conveying member 220 is disposed in the foremost advanced position.

At this time, the urging spring 241 is urged such that the waste toner conveying member 220 is separated from the drive input part 222. When portions of the urging force components of the urging spring 241 are applied in a direction in which the protrusion 223 of the waste toner conveying member 220 is bought into contact with the waste toner on the waste toner storage part 213, by adjusting positional relations of the drive input part 222 of the waste toner conveying member 220 and an engaging point of the urging spring 241 on the cleaning housing 201 side, the protrusion 223 of the waste toner conveying member 220 is brought into contact with the waste toner on the waste toner storage part 213.

Figure 12B:
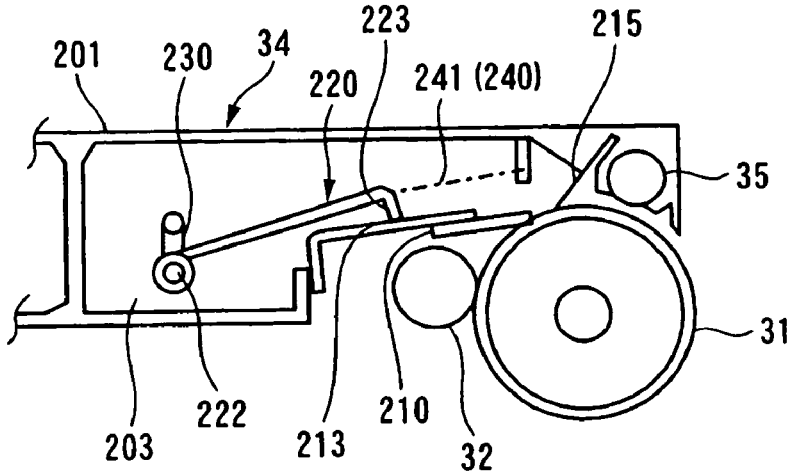

As shown in FIG. 12B, as the position of the drive input part 222 is rotated downward by the rotation drive mechanism 230 from the above-mentioned state, the waste toner conveying member 220 moves in the retracting direction while being gradually inclined. At this time, the protrusion 223 of the waste toner conveying member 220 conveys the waste toner on the waste toner storage part 213 to the waste toner accommodating chamber 203.

When the drive input part 222 of the waste toner conveying member 220 reaches the lowest point, the position of the waste toner conveying member 220 is in the steepest inclination state. In respect that the protrusion 223 of the waste toner conveying member 220 is maintained in contact with the waste toner storage part 213, and parts other than the protrusion 223 of the waste toner conveying member 220 is preferably not in contact with the waste toner storage part 213.

Figure 12C:
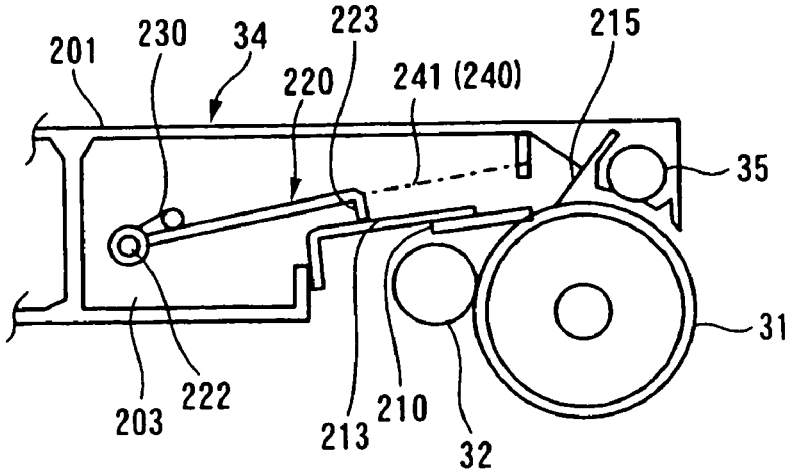

Afterwards, when the drive input part 222 of the waste toner conveying member 220 rotates up to the position shown in FIG. 12C, the waste toner conveying member 220 further moves in the retracting direction in a state being gradually released from the inclination position. At this time, since the urging spring 241 still urges the waste toner conveying member 220 to the waste toner storage part 213, the protrusion 223 of the waste toner conveying member 220 moves along with the waste toner storage part 213 in a state of contact with the waste toner Td, thus moving the waste toner Td to the waste toner accommodating chamber 203.

Figure 13A:
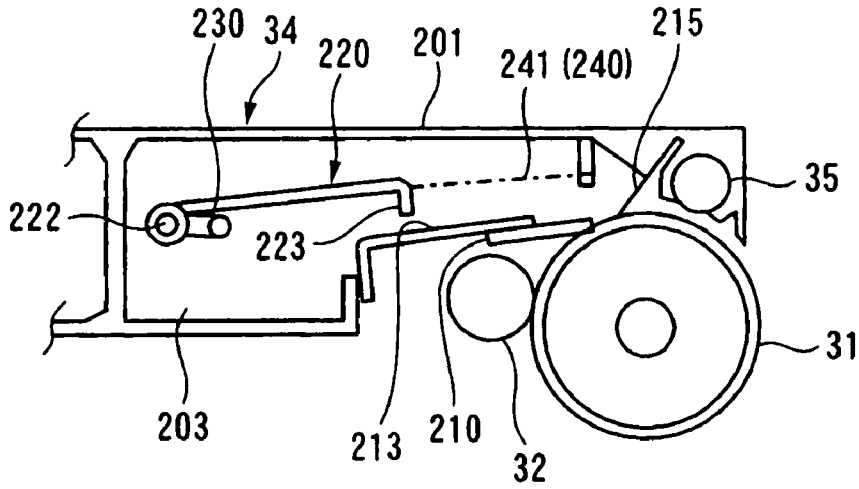
FIGS. 13A to 13C are views showing operation states of the cleaning unit according to the first embodiment when the waste toner conveying member moves in the advancing direction.

In this embodiment, as shown in FIGS. 12C and 13A, even though the waste toner conveying member 220 has reached the most retracted position, the protrusion 223 of the waste toner conveying member 220 does not move up to an end of the waste toner storage part 213 in the vicinity of the waste toner accommodating chamber 203. However, the waste toner which has been conveyed to the end of the waste toner storage part 213 in the vicinity of the waste toner accommodating chamber 203 is pushed by waste toner which is sequentially conveyed so as to be sequentially accommodated in the waste toner accommodating chamber 203.

In this embodiment, as shown in FIG. 13A, when the waste toner conveying member 220 reaches the most retracted position, the waste toner conveying member 220 is pulled by the urging force of the urging spring 241, and the protrusion 223 of the waste toner conveying member 220 is separated from the waste toner storage part 213, thus reaching a state just before the state of no contact with the waste toner storage part 213.

That is, since the waste toner conveying member 220 is urged in a predetermined direction by the urging spring 241, the disposing position of the waste toner conveying member 220 is defined on the basis of the positional relationship of the drive input part 222 of the waste toner conveying member 220 and the engaging point of the urging spring 241 on the cleaning housing 201 side. At this time, at a stage in which the waste toner conveying member 220 moves in the advancing direction, the protrusion 223 of the waste toner conveying member 220 should be disposed so as not to be in contact with the waste toner on the waste toner storage part 213.

Figure 13B:
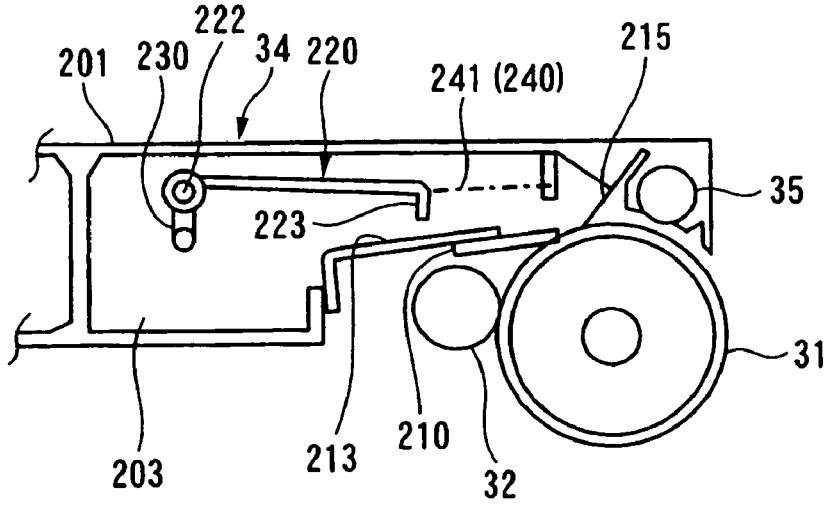

Afterwards, as shown in FIG. 13B, when the drive input part 222 of the waste toner conveying member 220 rotates upward, the waste toner conveying member 220 moves in the advancing direction while changing its inclined position so as to move the drive input part 222 upward.

At this time, the waste toner conveying member 220 is urged by the urging spring 241. When the drive input part 222 of the waste toner conveying member 220 moves upward, the location in which the waste toner conveying member 220 is disposed further moves upward. Thus, the protrusion 223 of the waste toner conveying member 220 is still disposed not in contact with the waste toner on the waste toner storage part 213.

Figure 13C:
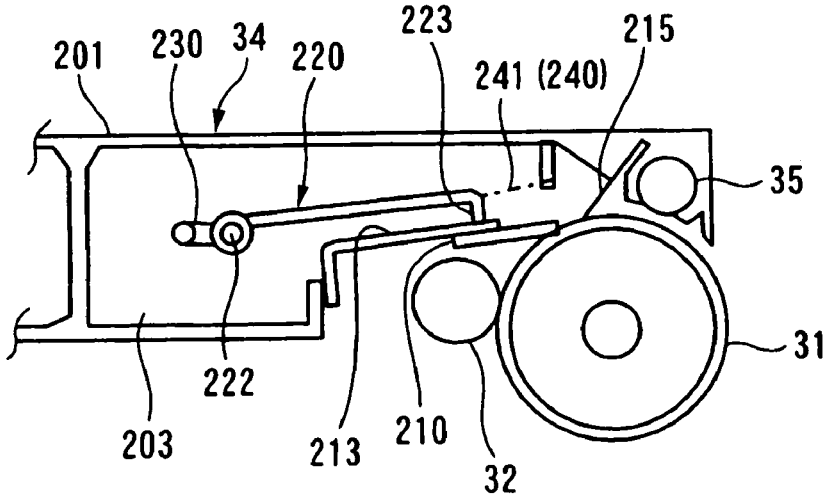

Afterwards, as shown in FIG. 13C, when the drive input part 222 of the waste toner conveying member 220 rotates in a direction where the drive input part 222 declines from a top dead point position, the waste toner conveying member 220 moves in the advancing direction while changing the inclined position so as to gradually approach the waste toner storage part 213. When the waste toner conveying member 220 has reached the most advanced position, the protrusion 223 of the waste toner conveying member 220 is again disposed in contact with the waste toner on the waste toner storage part 213.

In this way, since the protrusion 223 of the waste toner conveying member 220 moves in a state of no contact with the waste toner on the waste toner storage part 213 when the waste toner conveying member 220 moves in the advancing direction, the waste toner on the waste toner storage part 213 is effectively prevented from returning accompanying to the advancing movement of the waste toner conveying member 220. Thus, conveyance properties of waste toner can be maintained in good conditions.

Afterwards, the patterns shown in FIGS. 12A to 12C and FIGS. 13A to 13C are repeated.

In the embodiment, the waste toner conveying member 220 consistently moves in contact with the waste toner on the waste toner storage part 213 when the waste toner conveying member 220 moves in the retracting direction. However, the constitution is not limited to the above-mentioned, for example, the waste toner conveying member 220 may not move in contact with the waste toner on the waste toner storage part 213 at the initial stage and move in contact with the waste toner on the way while moving in the retracting direction. In addition, the waste toner conveying member 220 consistently moves not in contact with the waste toner on the waste toner storage part 213 when the waste toner conveying member 220 moves in the advancing direction. However, it is not limited to the above-mentioned constitution, for example, the waste toner conveying member 220 may move in contact with the waste toner on the waste toner storage part 213 at the initial stage and may not move in contact with the waste toner on the way while moving in the advancing direction.

Particularly, in the embodiment, when the drive input part 222 is in the top dead point position, the waste toner conveying member 220 maintains its highest position in the horizontal direction, and moves along a locus which does not protrude over the highest position. Moreover, the waste toner conveying member 220 moves in the advancing direction while maintaining its horizontal position. Therefore, an upper space of the waste toner accommodating chamber and an upper space of the waste toner storage part 213 can be set small. Thus, the cleaning unit 34 can be made slim.

In the embodiment, since the waste toner conveying member 220 has the aperture 224, when waste toner is conveyed by the waste toner conveying member 220, the waste toner is prevented from being collected on the waste toner conveying member 220, and the waste toner is also prevented from being dispersed by wind pressure due to air resistance.

In the embodiment, although the waste toner conveying member 220 moves in contact with waste toner along the waste toner storage part 213, it is not limited to the above-mentioned constitution. The waste toner conveying member 220 may move in contact with the waste toner on the waste toner storage part 213 in a state of no contact with the waste toner storage part 213. In this case, since the waste toner conveying member 220 moves in the retracting direction, the waste toner conveying member 220 is not directly in contact with the waste toner storage part 213. Thus, it is preferable since vibrations caused by the movement of the waste toner conveying member 220 can be prevented from being unnecessarily transferred to the photoconductive drum 31.

Developing Unit, Drive System of Cleaning Unit

In this embodiment, things to be described are used as the developing unit 33, the cleaning unit 34, and the drive system 300.

Figure 14:
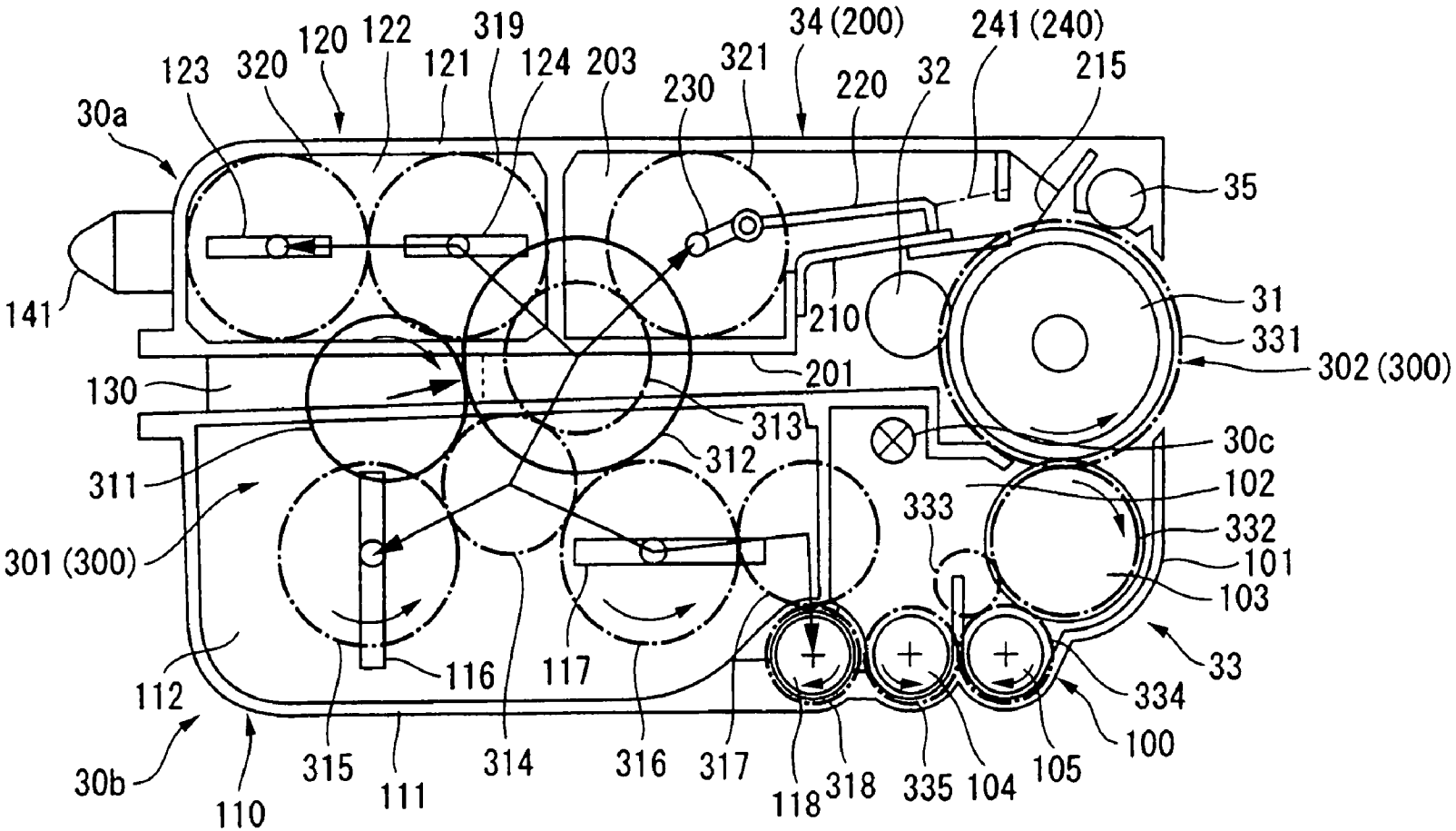
FIG. 14 is an explanatory view showing an example of a conveyance drive system and a development drive system which are used in the embodiment.

As shown in FIG. 14, the drive system 300 to be used in the embodiment is provided with each of the driven elements of the toner supply units 110 and 120 in the developing unit 33, a conveyance drive system 301 which drives each drive element of the cleaning unit 200 serving as the cleaning unit 34 by using one and the same drive source, a development drive system 302 which drives each drive element of the development unit 100 in the developing unit 33 by using a drive source other than that of the conveyance drive system 301.

Here, the conveyance drive system 301 has a drive input gear 311 that is subject to drive connection to a drive source (not shown), the drive input gear 311 is engaged with a first stage drive transfer gear 312. A shaft transfer gear 313 is provided on the same shaft as that of the drive transfer gear 312, and the shaft transfer gear 313 is engaged with drive transfer gears 315 and 316 which are connected to the agitators 116 and 117 of the main toner supply unit 110 by an idler gear 314. In addition, the drive transfer gear 316 is engaged with a dispense gear 318 which is connected to the dispense auger 118 by an idler gear 317.

In the conveyance drive system 301, the shaft transfer gear 313 is engaged with drive transfer gears 319 and 320 which are connected to the agitators 123 and 124 of the sub toner supply unit 120, and the shaft transfer gear 313 is engaged with a drive transfer gear 321 which is connected to the rotation shaft of the rotation drive mechanism 230 of the cleaning unit 200.

In the meantime, the development conveyance system 302 is provided with a drive transfer gear 331 having the same shaft as that of the photoconductive drum 31, the drive transfer gear 331 is engaged with the drive transfer gear 332 which is connected to the development roller 103. In addition, the drive transfer gear 332 is sequentially engaged with drive transfer gears 334 and 335 which are connected to the agitation carrying augers 104 and 105 by an idler gear 333.

A drive source is separated from a drive source of the conveyance drive system 301. On the other hand, if the development drive system 302 and the conveyance drive system 301 can be independently driven, each may use one or the same drive source.

In this way, according to the embodiment, since the conveyance drive system 301 and the development drive system 302 are set in a separate system, the toner conveying member (the agitators 116 and 117, the dispense auger 118, and the agitators 123 and 124) and the waste toner conveying member 220 need not be driven at all times during the development operation, as compared with the coupled system in which the conveyance drive system 301 and the development drive system 302 are coupled. Thus, energy loss due to driving operation can be decreased, the toner conveying member and the waste toner conveying member can be prevented from being deteriorated by abrasion, and the life span of the process cartridge 30 can be lengthened.

In addition, since the toner conveying member and the waste toner conveying member 220 having large load changes, and the photoconductive drum 31 and the development roller 103 which require rotating accuracy are separately driven, the rotation of the photoconductive drum 31 and the development roller 103 are not affected by vibrations caused by load changes of the toner conveying member and the waste toner conveying member 220. Thus, image deterioration can be prevented in advance.

In addition, when coupling and decoupling elements (such as a rotation gear) which enable drive force to be coupled to and decoupled from each drive element of the toner supply units 110 and 120 are provided in the conveyance drive system 301, the waste toner conveying operation can be performed independently of the toner supply operation. Further, when a coupling and decoupling element which enables the drive force to be coupled to and decoupled from, for example, the dispense auger 118 among the driving elements of the toner supply unit 110, the operation for agitating and conveying toner by the agitators 116, 117, 123, and 124 in the toner supply units 110 and 120 is performed without performing the toner supply operation by the dispense auger 118. Thus, supplying toner can be released periodically.

Second Embodiment

Figure 15:
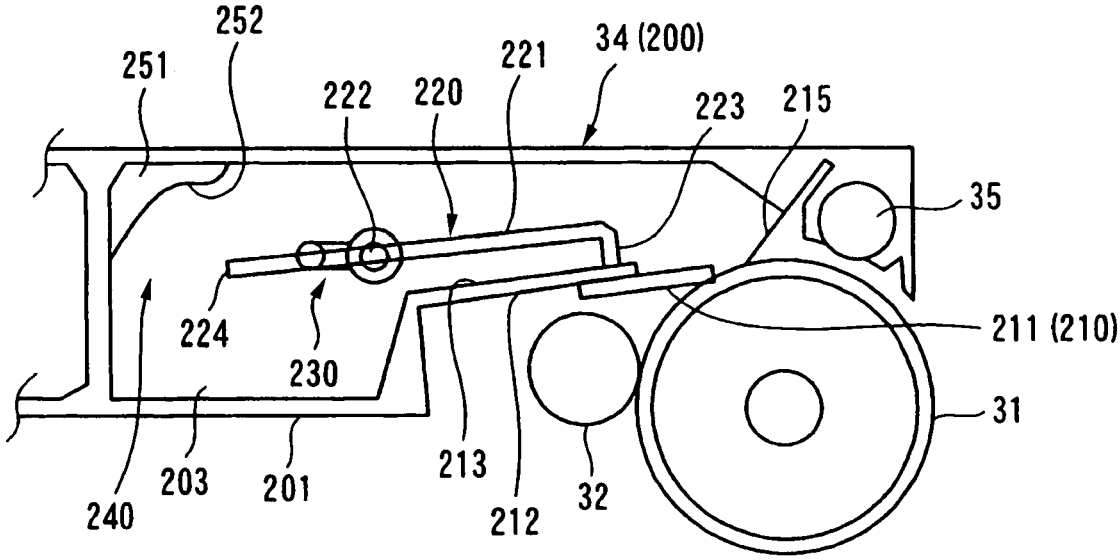
FIG. 15 is an explanatory view showing a cleaning unit according to a second embodiment of the invention.

FIG. 15 shows the cleaning unit according to a second embodiment of the invention.

In the drawing, the cleaning unit 34 is formed as substantially same as that of the first embodiment. Unlike the first embodiment, the location of the drive input part 222 of the waste toner conveying member 220 is changed, and the position regulating mechanism 240 is individually formed. In addition, constituent elements corresponding to those of the first embodiment are denoted by the same reference numerals, and a detailed description will be omitted.

In the second embodiment, the waste toner conveying member 220 has the drive input part 222 at a place separated from the end on the waste toner accommodating 203 side, and has its center position in a place biased to the drive input part 222.

The position regulating mechanism 240 is provided with a position restraint member 251 in a region extending over from the rear wall on the depth side to the upper wall, and a predetermined guide face 252 is formed on the surface of the position restraint mechanism 251.

The position restraint member 251 enables the end of the waste toner conveying member 220 on the waste toner accommodating chamber 203 side to be engaged with the guide face 252 when the waste toner conveying member 220 moves in the advancing direction, and the protrusion 223 of the waste toner conveying member 220 is not disposed in contact with the waste toner on the waste toner storage part 213.

Since the position restraint member 251 is not engaged with the waste toner conveying member 220 when the waste toner conveying member 220 moves in the retracting direction, the waste toner conveying member 220 is likely to rotate in a clockwise direction about the drive input part 222, and the protrusion 223 of the waste toner conveying member 220 is disposed in a natural position capable of contacting the waste toner storage part 213.

Next, the operation of the cleaning unit according to the second embodiment will be described.

Figure 16A:
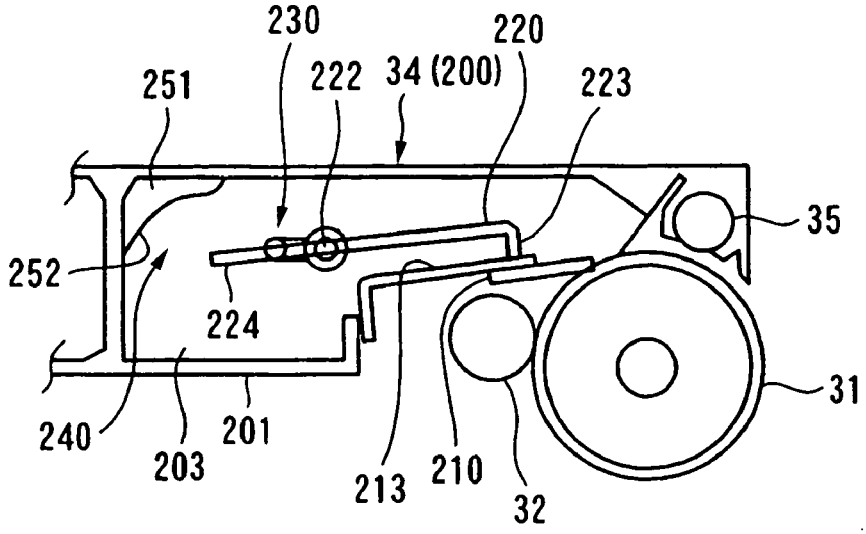
FIGS. 16A to 16C are explanatory view showing operation states of the cleaning unit when the waste toner conveying member moves in the retracting direction according to the second embodiment.

Here, as shown in FIG. 16A, when the waste toner conveying member 220 is disposed in the most advanced position, it is assumed that the waste toner conveying member 220 is not engaged with the position restraint member 251.

At this time, as shown in FIG. 16A, since the waste toner conveying member 220 is held in its natural position by the biased center position, the protrusion 223 of the waste toner conveying member 220 is disposed in contact with the waste toner storage part 213.

In this state, when the drive input part 222 rotates downward, the waste toner conveying member 220 moves in the retracting direction while changing its position. During this time, the protrusion 223 of the waste toner conveying member 220 moves in the retracting direction in a state in contact with the waste toner storage part 213, and conveys the waste toner to the waste toner accommodating chamber 203.

Figure 16B:
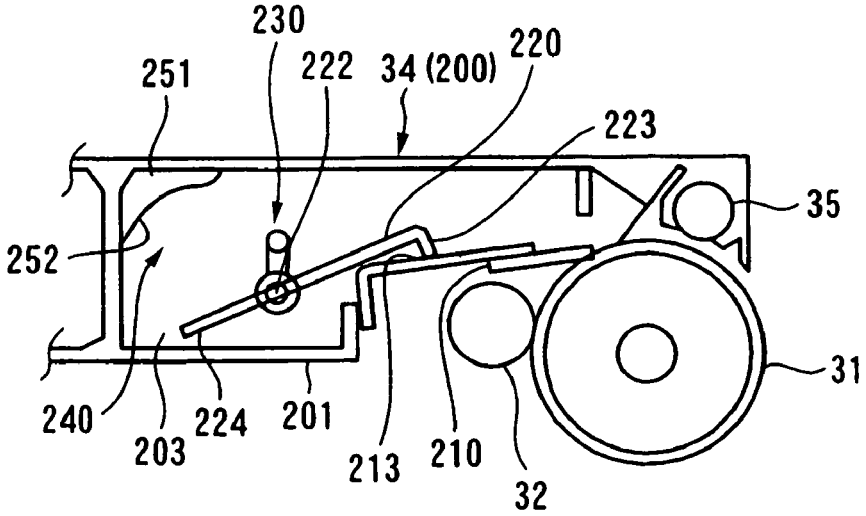

As shown in FIG. 16B, when the drive input part 222 of the waste toner conveying member 220 reaches the lowest point, a natural position of the waste toner conveying member 220 is inclined to the maximum. However, at this time, it is necessary that members other than the protrusion 223 of the waste toner conveying member 220 are disposed not in contact with the waste toner storage part 213 to improve conveyance efficiency, in order to ensure the connected state between the protrusion 223 of the waste toner conveying member 220 and the waste toner storage part 213.

Figure 16C:
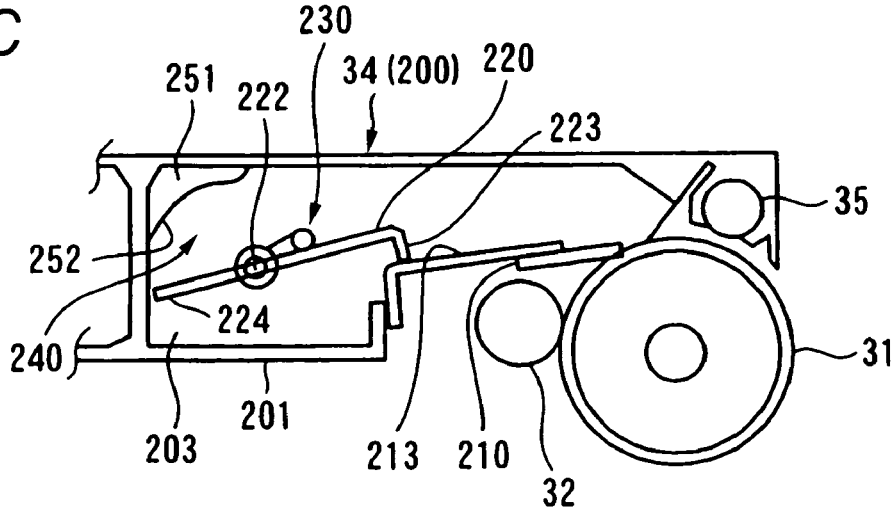

As shown in FIG. 16C, when the drive input part 222 of the waste toner conveying member 220 rotates again, the waste toner conveying member 220 further moves in the retracting direction while changing its inclined position. During this time, since the waste toner conveying member 220 moves in the retracting direction maintaining its naturally inclined position, the protrusion 223 of the waste toner conveying member 220 moves in contact with the waste toner storage part 213, thus conveying the waste toner to the waste toner accommodating chamber 203.

Figure 17A:
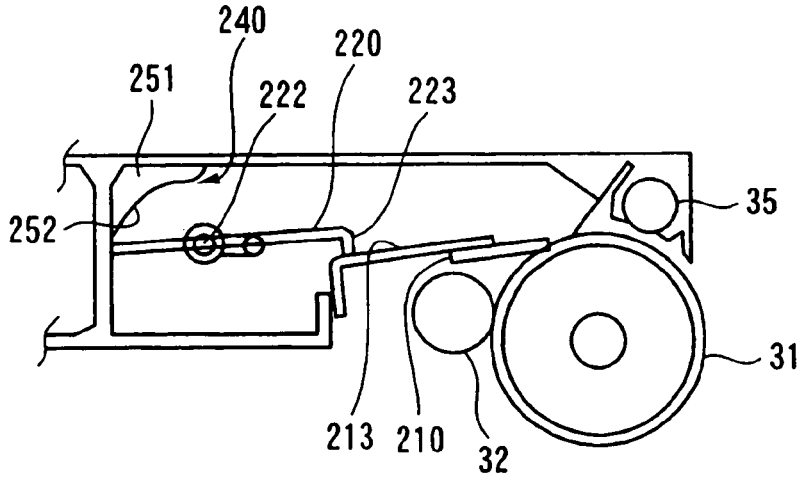
FIGS. 17A to 17C are explanatory views showing operation states of the cleaning unit when the waste toner conveying member moves in the advancing direction according to the second embodiment.

In the second embodiment, as shown in FIG. 16C and FIG. 17A, even though the waste toner conveying member 220 reaches the most retracted position, the protrusion 223 of the waste toner conveying member 220 does not move up to the end of the waste toner storage part 213 in the vicinity of the waste toner accommodating chamber 203. However, the waste toner which has been conveyed to the end of the waste toner storage part 213 in the vicinity of the waste toner accommodating chamber 203 is pushed by waste toner which is sequentially conveyed so as to be sequentially accommodated in the waste toner accommodating chamber 203.

In this way, the waste toner which is scraped off and collected by the cleaning blade 210 is compulsorily conveyed into the waste toner accommodating chamber 203 by the waste toner conveying member 220.

Figure 17B:
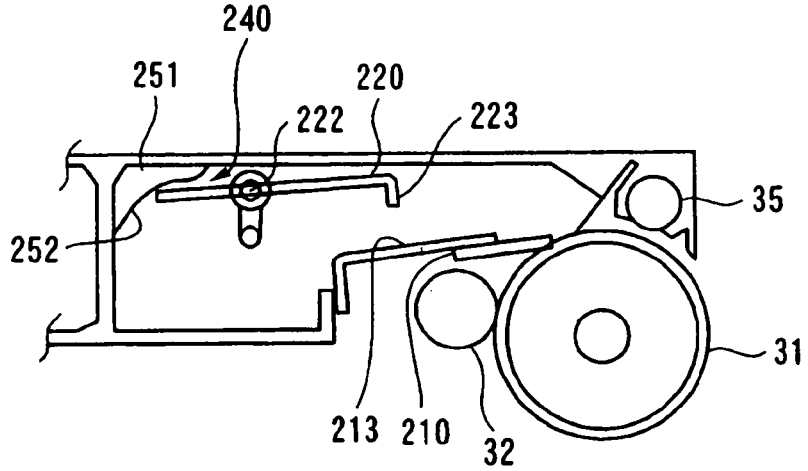

Next, as shown in FIGS. 17A and 17B, when the drive input part 222 of the waste toner conveying member 220 rotates and the waste toner conveying member 220 is about to move in the advancing direction from the most retracted position, an end (hereinafter, referred to as 'rear end') of the waste toner conveying member 220 on the waste toner accommodating chamber 203 side is engaged with the guide face 252 of the position restraint member 251. In the meantime, an inclined position of the waste toner conveying member 220 is under restraint so that the protrusion 223 of the waste toner conveying member 220 is not disposed in contact with the waste toner storage part 213.

At this time, it is preferable that the guide face 252 of the position restraint member 251 regulates the position of the waste toner conveying member 220 to become substantially horizontal, this is in consideration that the cleaning unit is made slim.

Particularly, as shown in FIG. 17B, when the drive input 222 of the waste toner conveying member 220 reaches the top dead point position, the top dead point position becomes the highest position of the waste toner conveying member 220.

However, it is preferable that the highest position is made substantially horizontal and the top dead point position is not over the highest position.

Figure 17C:
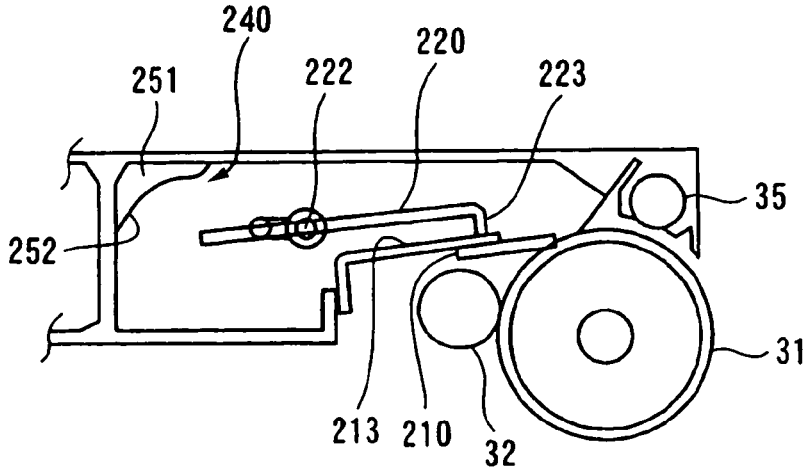

Afterwards, as shown in FIGS. 17B and 17C, when the drive input part 222 of the waste toner conveying member 220 rotates, the waste toner conveying member 220 moves in the advancing direction while the rear end of the waste toner conveying member 220 is being engaged with the guide face 252 of the position restraint member 251. At this time, until the waste toner conveying member 220 reaches the most advanced position, the protrusion 223 is kept not in contact with the waste toner storage part 213. When the waste toner conveying member 220 reaches the most advanced position, the protrusion 223 is again disposed in contact with the waste toner storage part 213.

In this way, since the protrusion 223 of the waste toner conveying member 220 moves not in contact with the waste toner on the waste toner storage part 213 when the waste toner conveying member 220 moves in the advancing direction, the waste toner on the waste toner storage part 213 is effectively prevented from returning accompanying to the advancing movement of the waste toner conveying member 220. Thus, conveyance properties of waste toner can be maintained in good conditions.

Afterwards, the patterns shown in FIGS. 16A to 16C and FIGS. 17A to 17C are repeated.

In the embodiment, the waste toner conveying member 220 consistently moves in contact with the waste toner on the waste toner storage part 213 when the waste toner conveying member 220 moves in the retracting direction. However, it is not limited to the above-mentioned constitution, for example, the waste toner conveying member 220 may not move in contact with the waste toner on the waste toner storage part 213 at the initial stage and move in contact with the waste toner on the way while moving in the retracting direction. In addition, the waste toner conveying member 220 consistently moves not in contact with the waste toner on the waste toner storage part 213 when the waste toner conveying member 220 moves in the advancing direction. However, it is not limited to the above-mentioned constitution, for example, the waste toner conveying member 220 may move in contact with the waste toner on the waste toner storage part 213 at the initial stage and may not move in contact with the waste toner on the way while moving in the advancing direction.

Third Embodiment

Figure 18A:
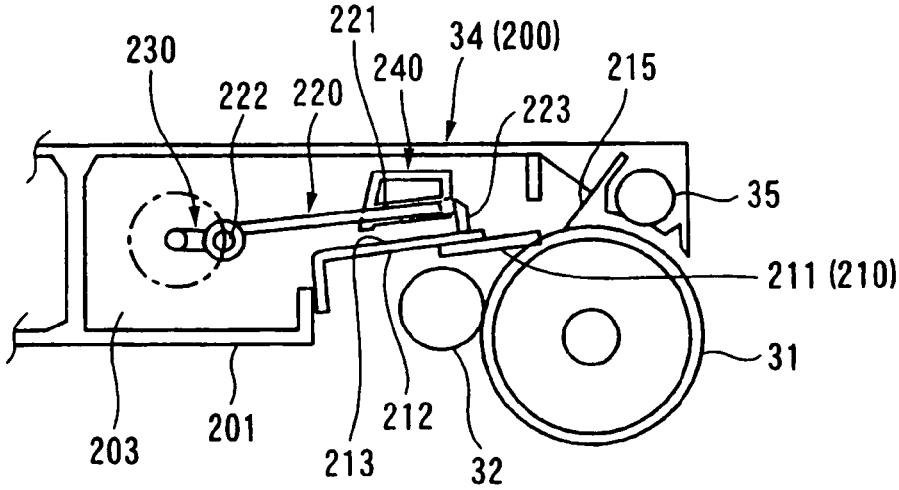
FIG. 18A is an explanatory view showing the cleaning unit according to a third embodiment of the invention.

FIG. 18A shows the cleaning unit according to a third embodiment of the invention.

In the drawing, the cleaning unit 34 is provided with the waste toner conveying member 220 (the conveyance plate 221, the drive input part 222, and the protrusion 223) as substantially the same as that of the first embodiment. However, unlike the first embodiment, the position regulating mechanism 240 is individually formed. In addition, constituent elements corresponding to those of the first embodiment are denoted by the same reference numerals, and a detailed description will be omitted.

Figure 18B:
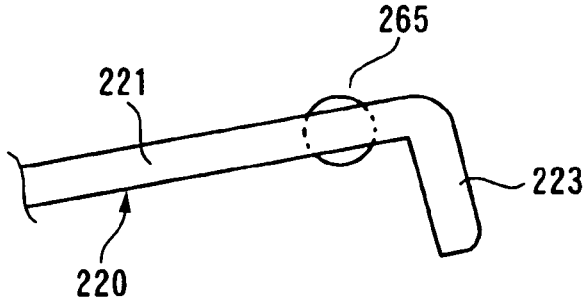
FIG. 18B is an explanatory view showing a guide pin of the waste toner conveying member in the vicinity of a protrusion.

In the third embodiment, as shown in FIG. 18A, the position regulating mechanism 240 is provided with a guide groove 260 (see FIG. 18C) which forms a predetermined moving locus on both side walls of the cleaning housing 201 corresponding to the waste toner storage part 213. A guide pin 265 (see FIG. 18B) is provided on both sides of the waste toner conveying member 220 in the vicinity of the protrusion 223 of the conveyance plate 221. The position of the waste toner conveying member 220 is regulated as the guide pin 265 is slidably engaged with the guide groove 260.

To be more specific, in the third embodiment, the guide groove 260 may be integrally formed with the cleaning unit 201 by directly performing emboss processing on both side walls of the cleaning housing 201. Otherwise, the guide groove 260 may be formed by bending a guide rail with a predetermined moving locus and the guide groove 260 may be mounted on both side walls on the cleaning housing 201 by a bracket.

Figure 18C:
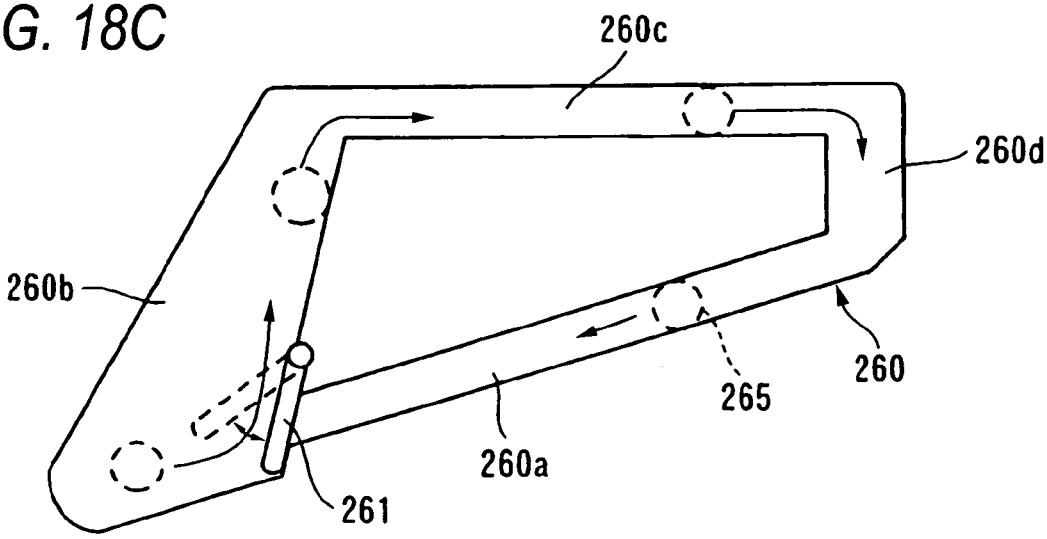
FIG. 18C is an explanatory view showing a guide groove to be used in the embodiment in detail.

Here, the guide groove 260 has an inclined lower transverse guide groove 260*a* which substantially follows the inclined surface of the waste toner storage part 213, as shown in FIG. 18C. A recession side longitudinal guide groove 260*b* is provided upward from the bottom end of the lower transverse guide groove 260*a*. An upper transverse guide groove 260*c* which extends toward the photoconductive drum 31 substantially in the horizontal direction from the top end of the recession side longitudinal guide groove 260*b* is provided. The advance side of the longitudinal guide groove 260*d* which connects the ends of the lower transverse guide groove 260*a* and the upper transverse guide groove 260*c* on the photoconductive drum 31 side is provided so as to form a closed loop. A one-way gate 261 is provided in a part communicated between the lower transverse guide groove 260*a* and the recession side longitudinal guide groove 260*b*, The one-way gate 261 exclusively allows the movement direction of the guide pine 265 from the lower transverse guide groove 260*a* to the recession side longitudinal guide groove 260*b*.

In the third embodiment, by the process in which the waste toner conveying member 220 moves in the retracting direction from the most advanced position to the most retracted position (in other words, the drive input part 222 of the waste toner conveying member 220 rotates from the most advanced position to the most retracted position via a bottom dead point position), the lower transverse guide groove 260*a* regulates the guide pin 265, so that the protrusion 223 of the waste toner conveying member 220 moves in contact with the waste toner on the waste toner storage part 213.

When the guide pin 265 passes by the one-way gate 261 and reaches the bottom end of the recession side longitudinal guide groove 260*b*, the one-way gate 261 is closed, so that the guide pin 265 never returns to the lower transverse guide groove 260*a*.

In addition, by the process in which the waste toner conveying member 220 moves in the advancing direction (in other words, the drive input part 222 of the waste toner conveying member 220 rotates toward the top dead point position from the most retracted position), the recession side longitudinal guide groove 260*b* pushes up the guide pin 265 and guides the guide pin 265 until the guide pin 265 abuts the upper transverse guide groove 260*c*.

Afterwards, by the process in which the waste toner conveying member 220 starts to move in the advancing direction (in other words, the drive input part 222 of the waste toner conveying member 220 rotates from the most retracted position to the most advanced position via the top dead point position), the upper transverse guide groove 260*c* regulates the position of the guide pin 265, so that the protrusion 223 of the waste toner conveying member 220 moves not in contact with the waste toner on the waste toner storage part 213.

In a stage in which the waste toner conveying member 220 reaches the most advanced position, the guide pin 265 reaches the end of the upper transverse guide groove 260*c* on the photoconductive drum 31 side, then the advance side longitudinal guide groove 260*d* guides the guide pin 265 downward and guides the guide pin 265 to the top end of the lower transverse guide groove 260*a*, so that the protrusion 223 of the waste toner conveying member 220 is disposed in contact with the waste toner on the waste toner storage part 213.

In this way, the position of the waste toner conveying member 220 is regulated on the basis of the engaging relations of the guide groove 260 and the guide pin 265.

Although the advance side transverse guide groove 260*d* is almost vertically formed, the advance side transverse guide groove 260*d* can be formed in a shape (inclined shape) for the purpose of decreasing vibrations which affects the photoconductive drum 31 or the like.

What is claimed is:

1. A cleaning unit comprising:

a cleaning housing which is open toward an image carrier and has a waste toner accommodating part capable of accommodating waste toner;

a cleaning member which is provided around an edge of an opening of the cleaning housing so as to form a part of a waste toner storage part or the entire waste toner storage part at a location close to the waste toner accommodating part of the cleaning housing and which scrapes and collects the waste toner on the image carrier, the waste toner storage part storing the waste toner temporarily; and a waste toner conveying member which conveys the waste toner scraped and collected by the cleaning member from the waste toner storage part toward the waste toner accommodating part of the cleaning housing, wherein:

the waste toner conveying member moves in the advancing/retracting direction along the waste toner storage part; and when the waste toner conveying member moves in the retracting direction toward the waste toner accommodating part, the waste toner conveying member moves in contact with the waste toner along at least the part of the waste toner storage part, and when the waste toner conveying member moves in the advancing direction, the waste toner conveying member moves along at least the part of the waste toner storage part without contacting the waste toner.

2. The cleaning unit according to claim 1, wherein the waste toner conveying member has a protrusion at a location separated from a driving force input part from which a driving force can be input, the protrusion being capable of coming in contact with the waste toner on the waste toner storage part.

3. The cleaning unit according to claim 1, wherein the waste toner conveying member has a member extending between the waste toner storage part and the waste toner accommodating part; and a portion of the member which faces a waste toner accommodating part is the driving force input part.

4. The cleaning unit according to claim 3, wherein the driving force input part is input with a driving power having a rotary locus.

5. The cleaning unit according to claim 4, wherein the waste toner conveying member is configured such that an opposite side of the driving force input part of the member moves along non-circular locus which has flat parts on the upper and lower parts.

6. The cleaning unit according to claim 4, wherein the driving force input part is input with a driving force rotating such that the waste toner accommodated in the waste toner accommodating part is pressed against a direction becoming separated from the cleaning member.

7. The cleaning unit according to claim 4, wherein when the driving force input part is located at the top dead center, and the waste toner conveying member keeps an approximately horizontal and uppermost position and moves along a locus not protruding upward from the uppermost position.

8. The cleaning unit according to claim 4, wherein:

the waste toner conveying member has a protrusion being capable of come in contact with the waste toner on the waste toner storage part; and when the driving force input part reaches a lowermost position, the waste toner on the waste toner storage part comes in contact with the protrusion and the member extending between the waste toner accommodating part and the waste toner storage part does not come in contact with the waste toner on the waste toner storage part.

9. The cleaning unit according to claim 1, wherein the waste toner conveying member moves in an approximately horizontal state when the waste toner conveying member moves in the advancing direction.

10. The cleaning unit according to claim 1, wherein:

the waste toner conveying member has a member extending between the waste toner storage part and the waste toner accommodating part; and the maximum moving distance of a waste toner storage part side of the member in a vertical direction is set to be smaller than that at a waste toner accommodating part side of the member.

11. The cleaning unit according to claim 1, wherein:

the waste toner conveying member has a member extending between the waste toner storage part and the waste toner accommodating part; and the member has a guide aiding part capable of guiding the waste toner with respect to a width direction perpendicular to the advancing/retracing direction of the member.

12. The cleaning unit according to claim 1, further comprising:

a position regulating mechanism for regulating the position of the waste toner conveying member.

13. The cleaning unit according to claim 12, wherein the position regulating mechanism is composed of an urging member, one end of the urging member being engaged with a portion separated from a driving force input point of the waste toner conveying member and the other end thereof being engaged with a part of the cleaning housing; and the waste toner conveying member is urged toward the direction becoming separated from the driving force input point.

14. The cleaning unit according to claim 13, wherein the urging member is disposed to be inclined with respect to the advancing/retracting direction of the waste toner conveying member.

15. The cleaning unit according to claim 13, wherein the urging direction of the urging member is inclined toward the vertical direction of the waste toner storage part rather than a surface of the waste toner storage part.

16. The cleaning unit according to claim 12, wherein:

the waste toner conveying member is disposed so as to be capable of coming in contact with the waste toner on waste toner storage part; and the position regulating mechanism has a position restraint member which is engaged with a part of the waste toner conveying member and makes the waste toner conveying member not contacting the waste toner on the waste toner storage part when the waste toner conveying member moves in the advancing direction.

17. The cleaning unit according to claim 16, wherein:

the waste toner conveying member has a protrusion at a location separated from a driving force input part from which a driving force can be input, the protrusion being capable of coming in contact with the waste toner on the waste toner storage part; and the center of the waste toner conveying member is located at a position deflected toward the protrusion with respect to the driving force input part.

18. The cleaning unit according to claim 12, wherein the position regulating mechanism has a position regulating guide which is engaged with a part of the waste toner conveying member and is capable of regulating the position of the waste toner conveying member.

19. The cleaning unit according to claim 1, wherein:

the waste toner conveying member has a plate shaped main body; and the main body is provided with a protrusion and an opening or a notch at a location where the protrusion is not provided, the protrusion being capable of coming in contact with the waste toner on the waste toner storage part.

20. The cleaning unit according to claim 1, wherein the waste toner storage part has an inclined surface portion inclined downward toward the waste toner accommodating part.

21. A process cartridge detachably mounted to a main body of an image forming apparatus, comprising:

an image carrier; and a cleaning unit including: a cleaning housing which is open toward an image carrier and has a waste toner accommodating part capable of accommodating waste toner; a cleaning member which is provided around an edge of an opening of the cleaning housing so as to form a part of a waste toner storage part or the entire waste toner storage part at a location close to the waste toner accommodating part of the cleaning housing and which scrapes and collects the waste toner on the image carrier, the waste toner storage part storing the waste toner temporarily; and a waste toner conveying member which conveys the waste toner scraped and collected by the cleaning member from the waste toner storage part toward the waste toner accommodating part of the cleaning housing, wherein:

the waste toner conveying member moves in the advancing/retracting direction along the waste toner storage part;

when the waste toner conveying member moves in the retracting direction toward the waste toner accommodating part, the waste toner conveying member moves in contact with the waste toner along at least the part of the waste toner storage part, and when the waste toner conveying member moves in the advancing direction, the waste toner conveying member moves along at least the part of the waste toner storage part without contacting the waste toner; and the cleaning unit is disposed to face the image carrier and is capable of cleaning up waste toner on the image carrier.

22. An image forming apparatus comprising:

a main body; and a process cartridge detachably mounted to a main body of an image forming apparatus, including: an image carrier; and a cleaning unit including: a cleaning housing which is open toward an image carrier and has a waste toner accommodating part capable of accommodating waste toner; a cleaning member which is provided around an edge of an opening of the cleaning housing so as to form a part of a waste toner storage part or the entire waste toner storage part at a location close to the waste toner accommodating part of the cleaning housing and which scrapes and collects the waste toner on the image carrier, the waste toner storage part storing the waste toner temporarily; and a waste toner conveying member which conveys the waste toner scraped and collected by the cleaning member from the waste toner storage part toward the waste toner accommodating part of the cleaning housing, wherein:

the waste toner conveying member moves in the advancing/retracting direction along the waste toner storage part;

when the waste toner conveying member moves in the retracting direction toward the waste toner accommodating part, the waste toner conveying member moves in contact with the waste toner along at least the part of the waste toner storage part, and when the waste toner conveying member moves in the advancing direction, the waste toner conveying member moves along at least the part of the waste toner storage part without contacting the waste toner; and the cleaning unit is disposed to face the image carrier and is capable of cleaning up waste toner on the image carrier.

23. An image forming apparatus comprising:

an image carrier; and a cleaning unit including: a cleaning housing which is open toward an image carrier and has a waste toner accommodating part capable of accommodating waste toner; a cleaning member which is provided around an edge of an opening of the cleaning housing so as to form a part of a waste toner storage part or the entire waste toner storage part at a location close to the waste toner accommodating part of the cleaning housing and which scrapes and collects the waste toner on the image carrier, the waste toner storage part storing the waste toner temporarily; and a waste toner conveying member which conveys the waste toner scraped and collected by the cleaning member from the waste toner storage part toward the waste toner accommodating part of the cleaning housing, wherein:

the waste toner conveying member moves in the advancing/retracting direction along the waste toner storage part;

when the waste toner conveying member moves in the retracting direction toward the waste toner accommodating part, the waste toner conveying member moves in contact with the waste toner along at least the part of the waste toner storage part, and when the waste toner conveying member moves in the advancing direction, the waste toner conveying member moves along at least the part of the waste toner storage part without contacting the waste toner; and the cleaning unit being disposed to face the image carrier and being capable of cleaning up waste toner on the image carrier.

* * * * *